US005595076A

United States Patent [19]

Weinerman et al.

[11] Patent Number: 5,595,076

[45] Date of Patent: Jan. 21, 1997

[54] HANDLE OPERABLE TWO-POINT LATCH AND LOCK

[75] Inventors: Lee S. Weinerman, Medina; Scott A. Arthurs, Brunswick, both of Ohio

[73] Assignee: The Eastern Company, Cleveland, Ohio

[21] Appl. No.: 577,718

[22] Filed: Dec. 22, 1995

Related U.S. Application Data

[63] Continuation-in-part of Ser. No. 510,470, Aug. 2, 1995, Pat. No. 5,564,295, which is a continuation of Ser. No. 145,691, Oct. 29, 1993, Pat. No. 5,439,260.

[51] Int. Cl.[6] ..... E05C 3/26; E05C 1/12

[52] U.S. Cl. ..... 70/208; 70/472; 292/DIG. 31; 292/34; 292/35

[58] Field of Search ..... 70/208, 109, 467, 70/489, 472; 292/34, 36, DIG. 31

[56] References Cited

U.S. PATENT DOCUMENTS

| | | | |
|---|---|---|---|
| 2,729,089 | 1/1956 | Pelcin | 70/151 |
| 3,333,878 | 8/1967 | Pelcin | 292/37 |
| 4,309,884 | 1/1982 | Davis | 70/472 |
| 4,312,203 | 1/1982 | Davis | 70/472 |
| 4,320,642 | 3/1982 | Pastva | 70/472 |
| 4,438,964 | 3/1984 | Peters | 292/216 |
| 4,641,865 | 2/1987 | Pastva | 292/5 |
| 4,706,478 | 11/1987 | Swan et al. | 70/208 |
| 4,892,338 | 1/1990 | Weinerman et al. | 292/35 |
| 4,896,906 | 1/1990 | Weinerman et al. | 292/48 |
| 4,911,487 | 3/1990 | Rachocki | 292/216 |
| 4,917,412 | 4/1990 | Swan et al. | 292/48 |
| 4,969,916 | 11/1990 | Weinerman et al. | 70/208 |
| 5,042,853 | 8/1991 | Gleason et al. | 292/126 |
| 5,058,937 | 10/1991 | Miehe et al. | 292/34 |
| 5,069,491 | 12/1991 | Weinerman et al. | 292/48 |
| 5,117,665 | 6/1992 | Swan et al. | 70/264 |
| 5,299,844 | 4/1994 | Gleason | 292/240 |
| 5,439,260 | 8/1995 | Weinerman et al. | 292/48 |

OTHER PUBLICATIONS

Versch Lock Mfg. Co., Inc., Columbia, SC, Two Untitled Product Information Sheets That Show RSL Series Paddle Locks, Date Unknown But Believed To Be Prior to Dec. 1995. See Also Two Pages of Versch Product Photos.

(List continued on next page.)

*Primary Examiner*—Lloyd A. Gall
*Assistant Examiner*—Tuyet-Phuong Pham
*Attorney, Agent, or Firm*—David A. Burge

[57] ABSTRACT

A versatile operating mechanism for a two-point latch or lock includes a "front" module having a flush-mountable handle and housing assembly that can be connected by simple fasteners to a "rear" module having a mounting bracket that movably supports linkage including an operating arm A pair of latch assemblies are connected to and operated by the mounting-bracket-mounted linkage. In preferred practice, rotary latch assemblies are used that each employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw for concurrently receiving and latchingly retaining within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches. The operating mechanism may be "locked" by positioning a movable locking member to extend into a path of movement of the operating arm to selectively permit and prevent movement of the operating arm along a path of movement.

52 Claims, 12 Drawing Sheets

OTHER PUBLICATIONS

TRI/Mark Corporation, New Hampton, IA, Three Untitled Product Information Sheets (Believed To Be pp. 8, 11 & 12 From A TRI/Mark Catalog) That Show Locks Of The 30–175, 30–400 and 30–450 Series, Date Unknown But Believed To Be Prior to Dec., 1995.

Cleveland Hardware, Cleveland, OH, One Untitled Product Information Sheet Showing A No. 1–2600–AH Lock, Date Unknown But Believed To Be Prior to Dec., 1995.

Eberhard Manufacturing Co. (Division Of The Eastern Company), Cleveland, OH, Catalog 106 Entitled "Industrial and Vehicular Hardware", 1994, pp. 26, 32–36, 64–65 and 71–75.

General Motors Corp., Detroit, MI, Photos Showing A Vehicle Handle Assembly Part No. 15686155 Which Has Been Available At Chevrolet Dealers Since At Least As Early As 1993.

HANDLE OPERABLE TWO-POINT LATCH AND LOCK

CROSS-REFERENCE TO RELATED AND RELEVANT CASES

The present application is a continuation-in-part of application Ser. No. 08/510,470, filed Aug. 2, 1995, by Lee S. Weinerman et al entitled HANDLE OPERABLE ROTARY LATCH AND LOCK issued Oct. 15, 1996 as U.S. Pat. No. 5,564,295, which, in turn, was filed as a continuation of application Ser. No. 08/145,691, filed Oct. 29, 1993, by Lee S. Weinerman et al entitled HANDLE OPERABLE ROTARY LATCH AND LOCK which issued Aug. 8, 1995, as U.S. Pat. No. 5,439,260, which applications are referred to hereinafter as the "Parent Cases," the disclosures of which are incorporated herein by reference.

Reference also is made to a companion design case that is being filed concurrently herewith, namely U.S. application Ser. No. 29/048,262, filed Dec. 22, 1995, by Lee S. Weinerman et al entitled HANDLE AND HOUSING ASSEMBLY FOR LATCH OR LOCK; and to a companion utility application that also is being filed concurrently herewith, namely U.S. Ser. No. 08/577,720, filed Dec. 22, 1995, by Lee S. Weinerman et al entitled HANDLE OPERABLE ROTARY LATCH AND LOCK. These applications are referred to hereinafter as the "Companion Cases," the disclosures of which are incorporated herein by reference.

Reference also is made to a related utility application that is being filed concurrently herewith, namely HANDLE OPERABLE ROTARY LATCH AND LOCK, U.S. Ser. No. 08/577,717, filed Dec. 22, 1995, by Lee S. Weinerman et al, referred to hereinafter as the "Sister Case," the disclosure of which is incorporated herein by reference.

Each of the aforementioned Companion and Sister Cases is a continuation-in-part of U.S. application Ser. No. 08/510,470, filed Aug. 2, 1995, by Lee S. Weinerman et al entitled HANDLE OPERABLE ROTARY LATCH AND LOCK issued Oct. 15, 1996, as U.S. Pat. No. 5,564,295, which, in turn, was filed as a continuation of U.S. application Ser. No. 08/145,691, filed Oct. 29, 1993, by Lee S. Weinerman et al entitled HANDLE OPERABLE ROTARY LATCH AND LOCK which issued Aug. 8, 1995, as U.S. Pat. No. 5,439,260.

BACKGROUND OF THE INVENTION

1. Field of the Invention

The present invention relates to a novel and improved operating mechanism for use with two or more latch assemblies to form a plural-point lock—typically a two-point lock that preferably employs a pair of slam-capable rotary latches that each has a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw to concurrently receive and latchingly retain within the confines of the first, second and third U-shaped notches a suitably configured strike formation, with housing side plate portions that define a selected one of the first and second U-shaped notches being rigidified and strengthened by the close proximity presence of a flange 1) that is formed integrally with side plate portions that define the selected notch and 2) that extends transversely to bridge between the housing side plates at a location near the first and second U-shaped notches. Features of the invention also reside in the versatile, modular nature of the operating mechanism, and in advantages provided by formations of "front" and "rear" operating mechanism "modules" that cooperate to reinforce and strengthen the resulting lock to provide a reliable, tamper-resistant operating mechanism capable of functioning well during a lengthy service life.

2. Prior Art

Flush mountable lock operating mechanisms that employ paddle-type handles nested within pan-shaped housings, and that have linkages for operating plural, remotely located latch assemblies are known. However, known operating mechanisms tend not to be "modular" (i.e., they tend not to group their components to form "front" and "rear" assemblies or "modules"). Known forms of flush-mountable, paddle-handle-operable, plural-point locks having "non-modular" operating mechanisms are exemplified by U.S. Pat. No. 4,706,478 issued Nov. 17, 1987 to Jye P. Swan et al, entitled ROTARY HANDLE OPERATED DOOR LOCK, and U.S. Pat. No. 4,892,338 issued Jan. 9, 1990 to Lee S. Weinerman et al, entitled PLURAL POINT DOOR LOCK AND FLUSH-MOUNTABLE OPERATING MECHANISM WITH DETENT, the disclosures of which patents are incorporated herein by reference.

A variety of two-point latches and locks having operating mechanisms that are neither "modular" nor flush-mountable also are known, as typified by U.S. Pat. No. 2,729,089 issued Jan. 3, 1956 to Albert L. Pelcin, entitled SOLENOID-CONTROLLED DOOR LOCK; U.S. Pat. No. 3,333,878 issued Aug. 1, 1967 to Albert L. Pelcin, entitled DOOR CONTROL MECHANISM; and U.S. Pat. No. 4,641,865 issued Feb. 10, 1987 to John V. Pastva, entitled CLOSURE CONTROL MECHANISM, the disclosures of which are incorporated herein by reference.

Flush-mountable operating mechanisms that are "non-modular" and that employ relatively complex arrangements of motion-transmitting links that extend between operating mechanisms and remotely located rotary latch assemblies also are known, as is exemplified by U.S. Pat. No. 4,896,906 issued Jan. 30, 1990 to Lee S. Weinerman et al, entitled VEHICLE DOOR LOCK SYSTEM; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 5,069,491 issued Dec. 3, 1991 to Lee S. Weinerman et al, entitled VEHICLE DOOR LOCK SYSTEM; and, U.S. Pat. No. 5,117,665 issued Jun. 2, 1992 to Jye P. Swan et al, entitled VEHICLE DOOR LOCK SYSTEM, the disclosures of which are incorporated herein by reference.

Flush mountable, paddle-handle-operated latches and locks are known that employ "non-modular" operating mechanisms that are carried directly on pan-shaped housings together with rotary latch assemblies, as is exemplified by U.S. Pat. No. 4,320,642 issued Mar. 23, 1982 to John V. Pastva, Jr., entitled PADDLE LOCKS WITH HANDLE DISCONNECT FEATURES, the disclosure of which is incorporated herein by reference.

The rotary latch assemblies that are disclosed in several of the above-mentioned patents are of a relatively heavy duty type and often are employed in "personnel restraint applications," typically on doors of passenger compartments of vehicles. These heavy duty units employ pairs of housing-mounted rotary jaws, with the jaws being sandwiched between pairs of housing side plates, with the jaws and a rotary pawl being supported for movement by bushings that extend between and are rigidly connected at their opposite ends to the housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of this patent also is incorporated herein by reference.

3. The Referenced Parent Cases

Not addressed by the patents that are identified above is a long-standing need for a relatively light duty rotary latch that employs only a single rotary jaw instead of a pair of rotary jaws, that employs first and second housing side plates that define, respectively, first and second notches that are of generally U-shape, with the first and second U-shaped notches being positioned and aligned for cooperating with a third U-shaped notch that is formed in the single rotary jaw to receive and latchingly retain within the confines of the first, second and third notches a suitably configured strike formation, and with the latch making advantageous use of a transversely extending flange that is formed integrally with one of the first and second housing side plates to rigidify and strengthen housing side plate portions that define a strike-engaging surface of at least one of the aligned first and second U-shaped notches. Features of the inventions of the referenced Parent Cases address this need, and, in preferred practice, the present invention employs some of these features.

Also not addressed by the patents that are identified above is a long-standing need for a two-point latch and/or lock that has its operating mechanism divided between a pair of easy-to-mount front and rear "modules," with the front module being flush-mountable, and with the rear module including a stamped metal mounting bracket 1) that assists in securely mounting the handle and housing of the "front" module on a closure, and 2) that itself mounts linkage including an operating arm that is connectible to a variety of types of latch assemblies including the advantageous type of rotary latch assembly that is described above. The inventions of the referenced Parent Cases do not concern themselves with plural-point locks and latches, but do utilize modular operating mechanisms and rotary latch assemblies.

4. The Referenced Companion and Sister Cases

The referenced Companion Design Case relates to a design for a Handle and Housing Assembly that is employed in carrying out the preferred practice of the present invention. The referenced Companion Utility Case relates to a Handle Operated Rotary Latch and Lock that preferably utilizes the design of the Companion Design Case, and that preferably shares other features in common with the present invention and the inventions of the Parent Cases. The invention of the referenced Sister Case preferably makes use of selected features of the present invention and the inventions of the Parent Cases.

SUMMARY OF THE INVENTION

In preferred practice, the present invention provides a novel and improved operating mechanism that has its components divided between a set of "front" and "rear" assemblies or "modules" that cooperate advantageously to do such things as reinforce each other; and, in preferred practice, the present invention not only makes use of a rotary latch subassembly of a type that is disclosed in the referenced Parent Cases but also provides improvements thereto. However, the novel operating mechanism also can be used with a wide variety of other latch assemblies; and the rotary latch assembly has an improvement feature that does not require the presence of the "modular" operating mechanism and, in fact, can be utilized with other forms of rotary latches, such as those that are disclosed in several of the aforementioned patents.

To the extent that the preferred practice of the present invention includes a rotary latch improvement, it has to do with the use of hex-shaped holes that are provided in one or both of the side plates of the housing of a rotary latch, into which extend reduced diameter end regions of bushings on which a rotary pawl and one or more rotary latch bolts are mounted, and within which the end regions of the bushings are expanded to form secure, rigid connections with the side plates. The use of hex-shaped holes, and the expansion of bushing end regions to closely fit the hex-shaped holes, provides a secure connection between the bushings and the side plates that is highly resistant to loosening, and that prevents bushings from rotating relative to the side plates.

To the extent that the preferred practice of the present invention makes use of Parent-Case-type rotary latches, such latches are formed from components that include a generally elongate, generally rectangular first housing side plate having opposed end regions near opposite ends of the length thereof, and defining a first U-shaped notch located near one of the opposed end regions of the first housing side plate; an elongate, generally rectangular second housing side plate having opposed end regions near opposite ends of the length thereof, and defining a second U-shaped notch located near one of the opposed end regions of the second housing side plate, with the second U-shaped notch being configured to substantially align with the first U-shaped notch; spacer means for extending transversely between, for rigidly connecting with, and for holding in substantially parallel relationship the first and second housing side plates, with the spacer means including a first spacer that extends along a first transverse axis that intersects each of the first and second housing side plates at a location that is relative near to the other end regions thereof, and with the spacer means also including a second spacer that extends along a second transverse axis that intersects each of the first and second housing side plates at a location that is substantially mid-way between the opposite ends thereof; with the rotary latch bolt means including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with the selected housing side plate.

To the extent that the preferred practice of the present invention makes use of an operating mechanism that divides its components among "front" and "rear" assemblies or "modules," features of the invention reside 1) in providing a handle and housing assembly that forms a "front" module that is installed by inserting portions of its housing through the front side of a mounting opening that is formed in the front wall of a closure; 2) in providing a "rear" module that includes a mounting bracket, a bracket-carried pivotally-mounted operating arm, and a bracket-carried pivotally-mounted lever that is movable between "latched" and "unlatched" positions, to which suitable linkage can be attached for connection to remotely mounted latch assemblies to enable the operating mechanism to concurrently "unlatch" the latch assemblies; and 3) in configuring these front and rear modules such that they can be clamped securely in place when installed adjacent a mounting opening of a closure simply by tightening in place a set of threaded fasteners that extend through portions of one of the modules so as to be received in portions of the other of the modules, with this simple mounting technique serving to securely connect, align and ensure registry of the operating mechanism modules.

By optionally providing a front-module-mounted key-operable lock mechanism for selectively positioning a locking member to extend into the path of movement of the back-module-mounted operating arm, the transfer of unlatching force from the operating mechanism through the operating arm to such remotely located latch assemblies as are linkage-connected to the operating mechanism is selectively permitted and prevented. In preferred practice, if an optional front-module-mounted lock mechanism is provided, the bracket of the rear module is provided with an opening through which rearwardly extending portions of the lock mechanism extend in a slip fit, by which arrangement the rear module bracket serves to strengthen and reinforce the mounting of the lock mechanism without having to be directly connected thereto by one or more fasteners.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
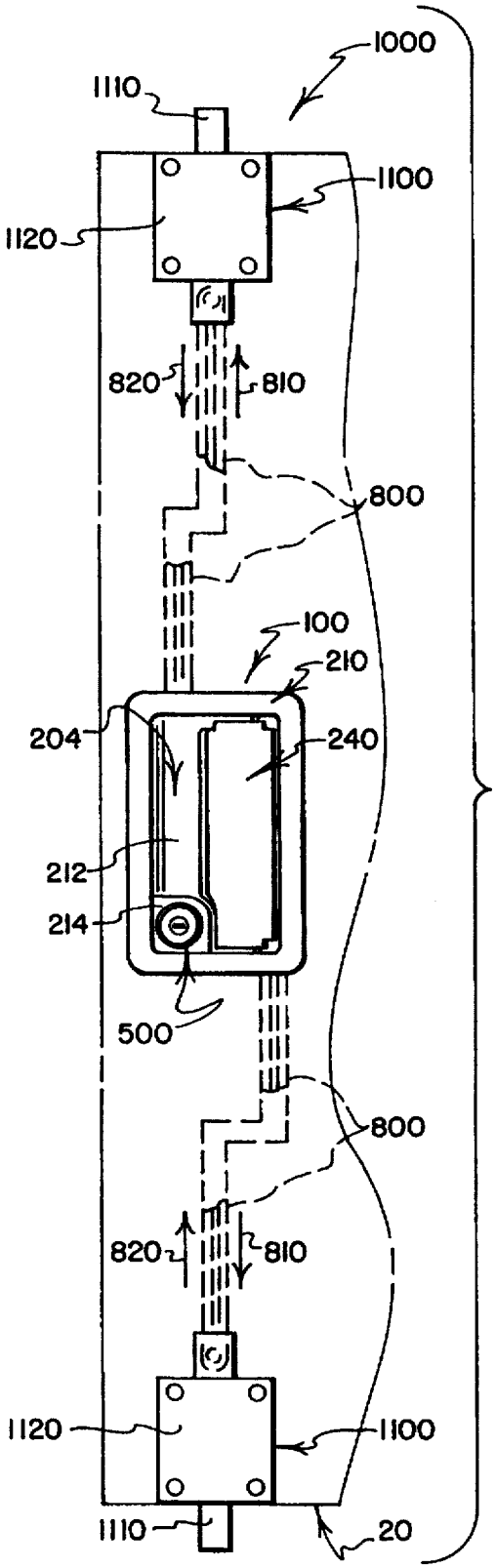
FIG. 1 is front side elevational view of a first embodiment of a plural-point door lock that has a flush-mountable operating mechanism that incorporates features of the present invention, with portions of two elongate links that interconnect the operating mechanism with a pair of remotely located slide bolt assemblies being foreshortened, and with portions of a door on which the lock is mounted being outlined in phantom.
Figure 2:
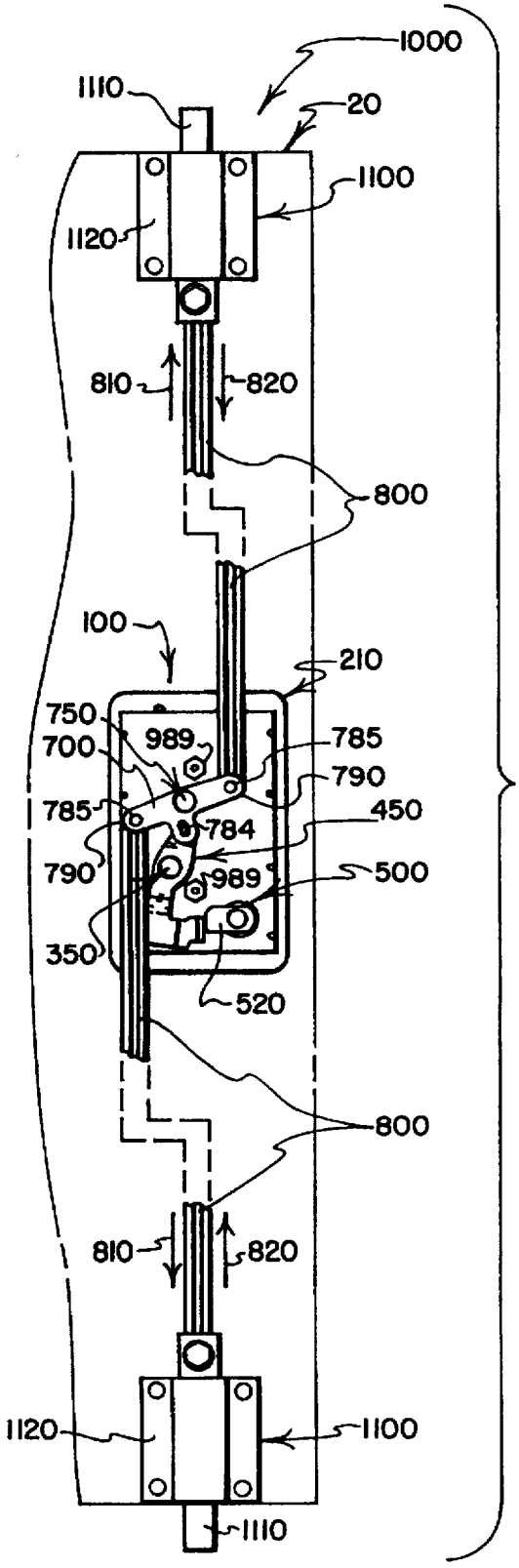
FIG. 2 is a rear side elevational view thereof.
Figure 3:
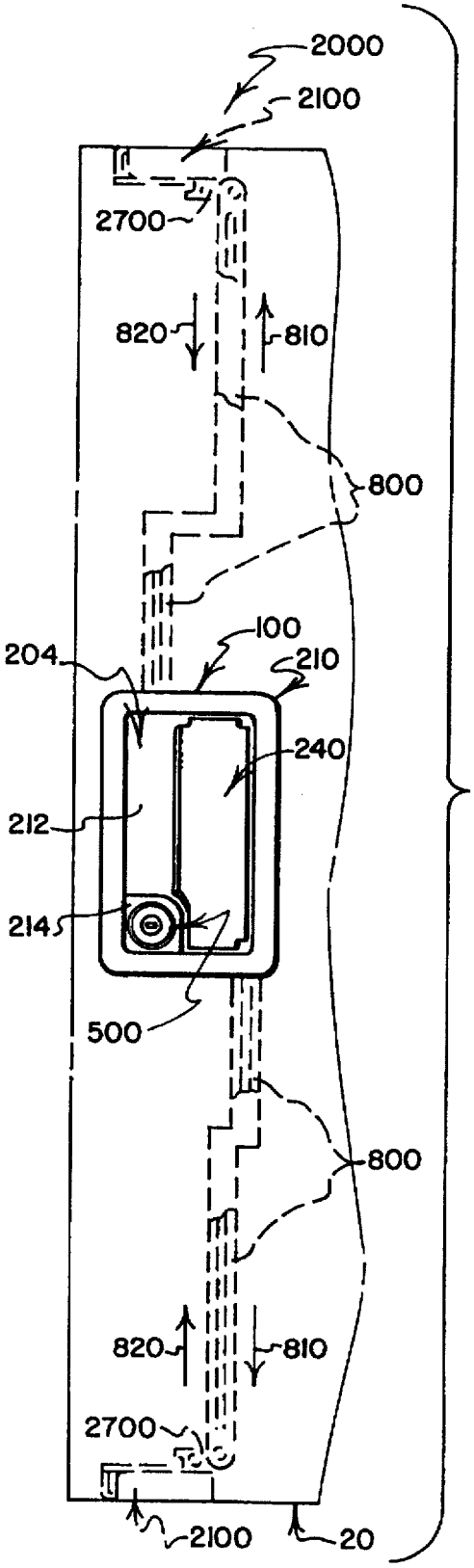
FIG. 3 is a front side elevational showing a second embodiment of a plural-point door lock that utilizes the flush-mountable operating mechanism of the first embodiment, with portions of two elongate links that interconnect the operating mechanism with a pair of remotely located rotary lock assemblies being foreshortened, and with portions of a door on which the lock is mounted being outlined in phantom.
Figure 4:
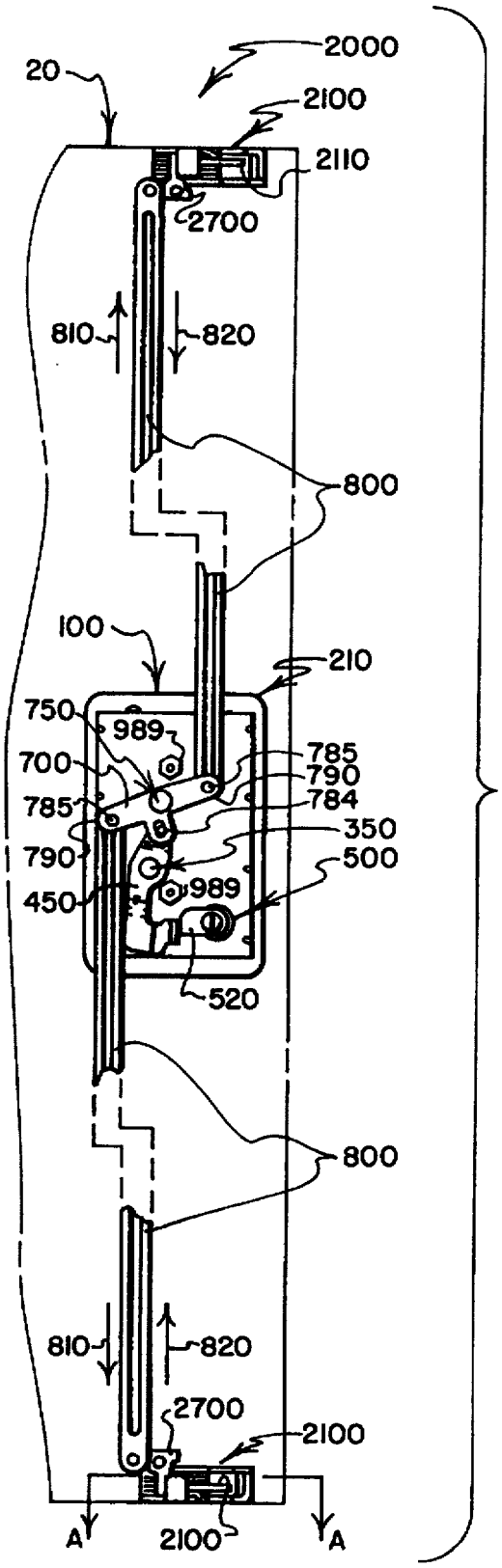
FIG. 4 is a rear side elevational view thereof.

In the description that follows, the discussion that is associated with FIGS. 1 and 2 relates to a first embodiment of a "plural-point" door lock that is indicated generally by the numeral 1000; and, the discussion that is associated with FIGS. 3 and 4 relates to a second embodiment of a "plural-point" door lock that is indicated generally by the numeral 2000. The lock embodiments 1000, 2000 are substantially identical except that the first lock embodiment 1000 utilizes a pair of identical latch assemblies 1100 that have spring-projected slide-type latch bolts 1110, while the second lock embodiment utilizes a pair of rotary latch assemblies 2100 that are substantially identical (a difference being that each is a "mirror image reversal" of the other, whereby one is said to be "left" and the other is said to be "right") and have rotary latch bolts 2110 (best seen in FIGS. 16–21). The first and second lock embodiments 1000, 2000 utilize identical operating mechanisms 100, features of which are depicted in FIGS. 5–14.

While rigid, elongate links 800 (typically formed as stampings from metal) are depicted in FIGS. 1–4 as being utilized to connect the operating mechanisms 100 to the latch assemblies 1100, 2100, those who are skilled in the art will understand that a variety of other types of linkage (e.g., including flexible links comprised of chain or woven steel cable, not shown) may be substituted for the links 800. While the links 800 of the lock embodiments 1000, 2000 connect with the operating mechanisms 100 in a manner that permits the operating mechanisms 100 to exert a "tension" or "pulling" type of force along the links 800, those who are skilled in the art will understand that the operating mechanism 100 also is well suited for use in applying a "compression" or "pushing" type of force (along a set of suitably rigid links, not shown) to operate such latch mechanisms as may require this type of force application to "unlatch."

While the operating mechanism 100 is depicted in the drawings as employing pairs of links 800 that connect with only two of the latches 1100, or with only two of the latches 2100, those who are skilled in the art will understand that suitable linkage may be substituted for one or both of the links 800 for connecting with a larger number of latches (not shown) to effect concurrent "unlatching" of more than two latches. Thus, while the drawings depict latches 1100 having spring-projected slide bolts 1110 and latches 2100 having rotary latch bolts 2110, it will be understood that the operating mechanism 100 may be used with a variety of other types of commercially available latch assemblies, and with numbers of latch assemblies that differ from "two."

However, if the operating mechanism 100 is to be utilized with rotary latch assemblies to form a two-point lock (such as the lock 2000 that is depicted in FIGS. 3 and 4), the best mode known to the inventors for carrying out the preferred practice of the present invention calls for the operating mechanism 100 to be of the type that is depicted in FIGS. 5–14, and for the rotary latches to be of the type depicted in FIGS. 16–21.

Figure 15:
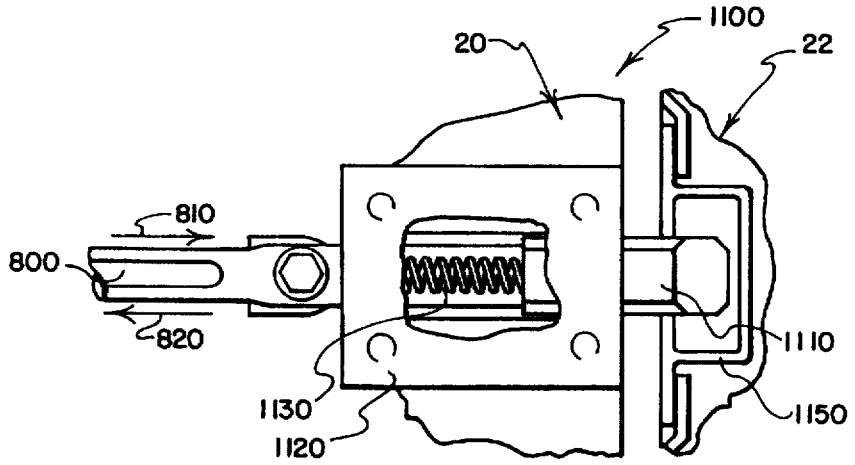
FIG. 15 is a front side elevational view, on an enlarged scale, of one of the latch bolt assemblies that is depicted in FIGS. 1 and 2, together with portions of an associated strike and portions of a door frame on which the strike is mounted, with portions thereof broken away to permit underlying features to be seen.

Referring to FIGS. 5–11, the flush-mountable operating mechanism 100 is shown mounted on a door or closure 20. The closure 20 typically is formed from at least one stamped metal sheet 32 (or as a welded assembly of metal sheets, not shown), with a generally rectangular mounting openings 34 (see FIGS. 8, 10 and 11) being provided, through which portions of the operating mechanism 100 project. The closure 20 is movable between open and closed positions with respect to nearby structure such as a door frame, portions of which are depicted in FIG. 15, as indicated by a numeral 22.

Figure 11:
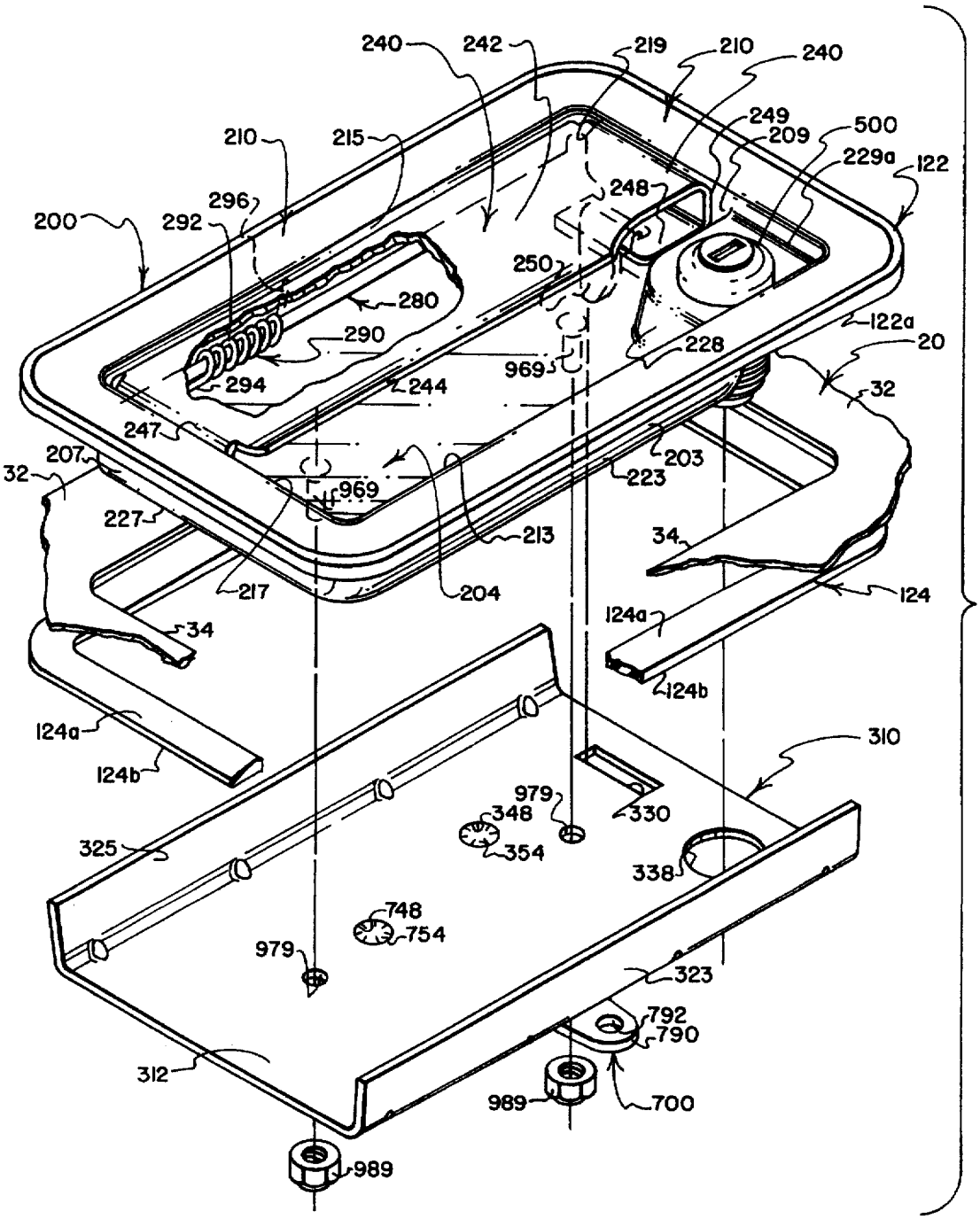
FIGS. 11, 12 and 13 are exploded front perspective views of selected components of the operating mechanism of FIGS. 5–10, with some components separated so as to be depicted individually, with other components shown assembled, and with some component portions broken away to permit underlying features to be viewed.
Figure 12:
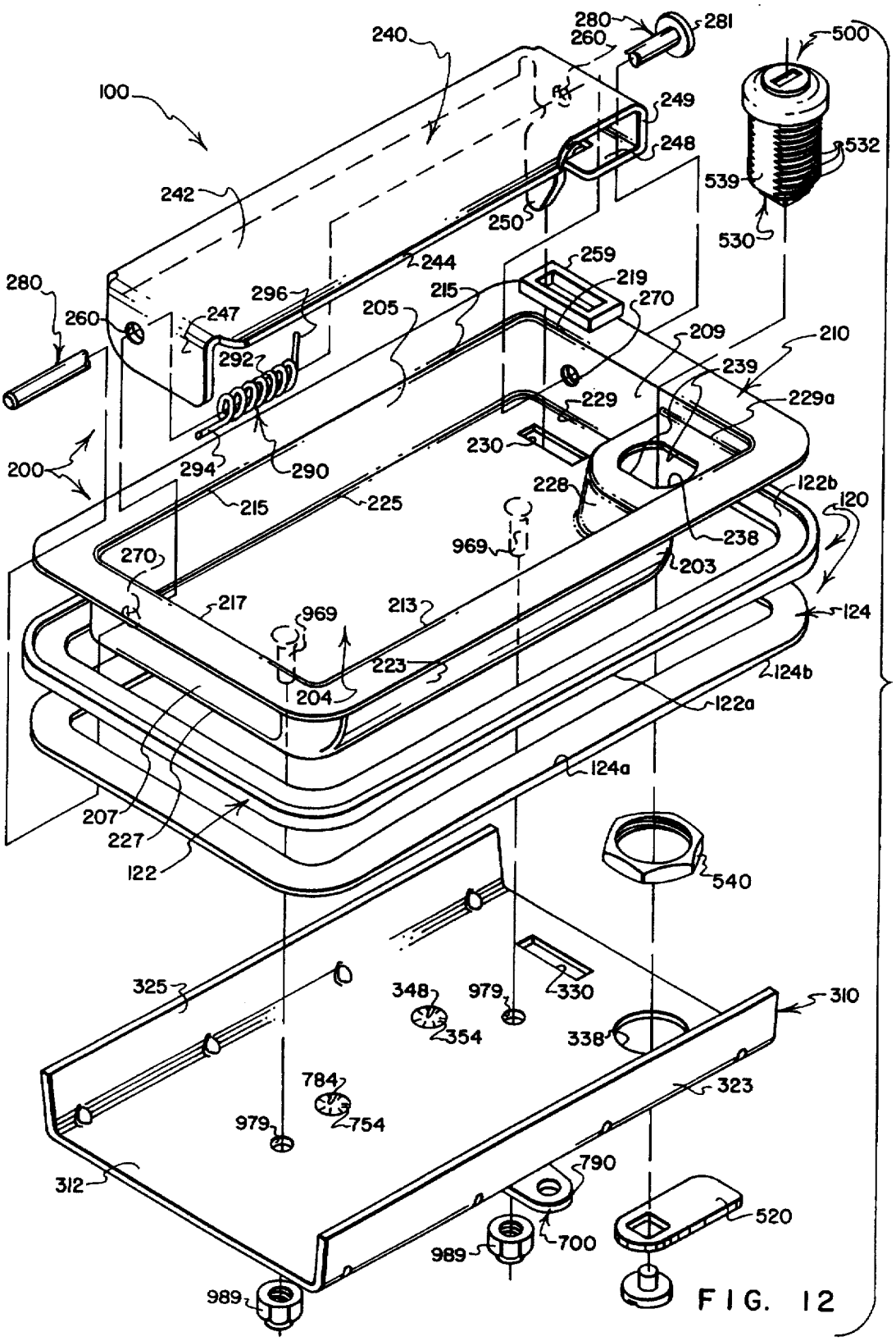

While the metal sheet 32 of the closure 20 is depicted in the drawings (see FIG. 6) as having a very slight outwardly convex curvature (which is dealt with by providing a gasket set 120—including an outer gasket 122 and an inner gasket 124 that have complementarily curved surfaces **122*a*, 124*a* and opposed flat surfaces 122*b*, 124*b*, as best seen in FIGS. 11 and 12—that permits the operating mechanism 100 to be installed with a proper weather-tight seal being established about the mounting opening 34), those who are skilled in the art will understand that the operating mechanism 100 also can be installed in a mounting opening formed through a flat sheet (not shown) simply by substituting for the special gasket set 120 a simple, conventional, flat gasket(not shown) to surround the mounting opening and to underlie the flat mounting flange 202 of the pan-shaped housing 210 of the operating mechanism 100**. A more complete discussion of the provision of special, curvature-accommodating gaskets vs. simple flat gaskets is provided in the referenced Companion Utility Case, the disclosure of which is incorporated herein by reference.

Figure 13:
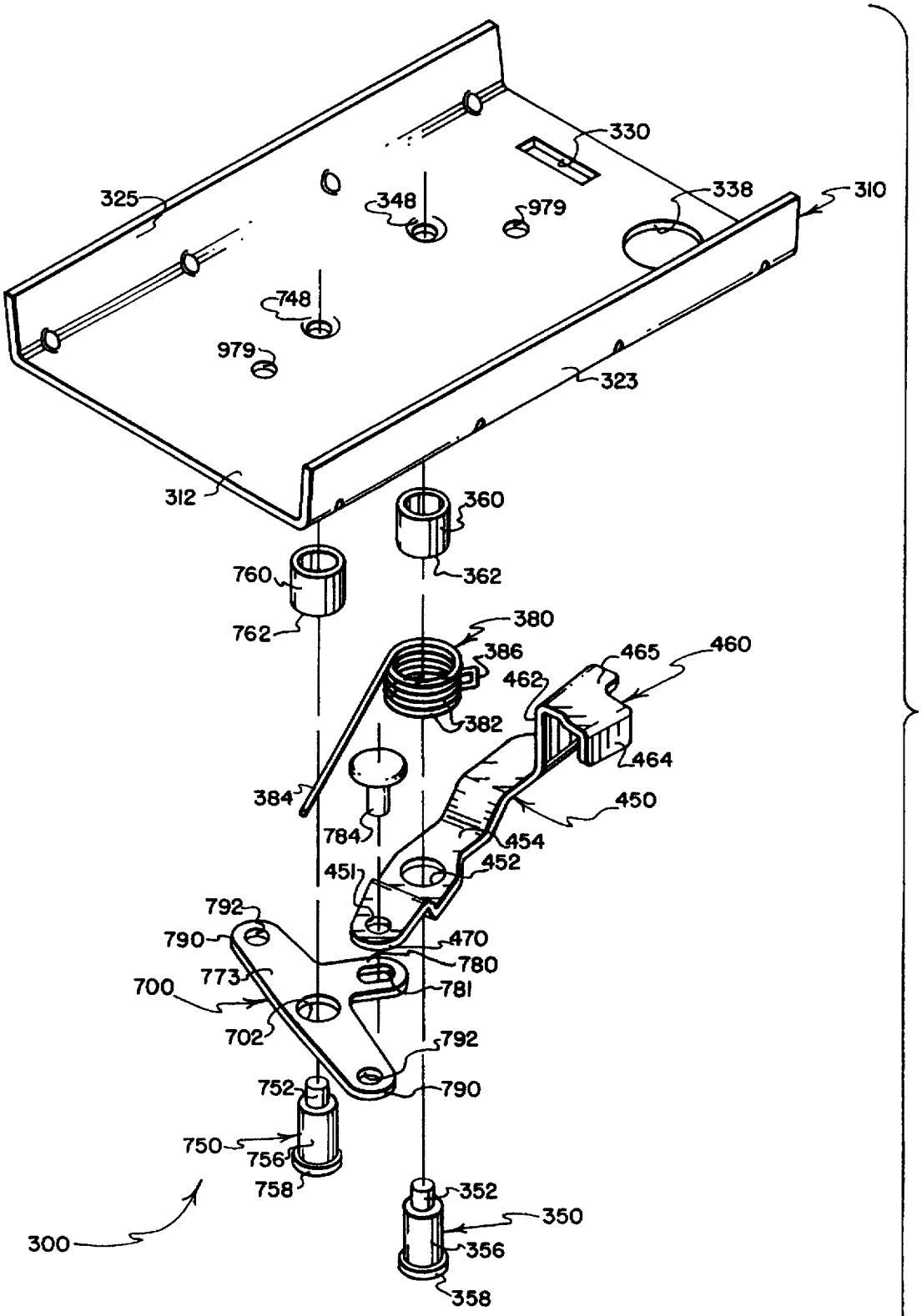
Figure 14:
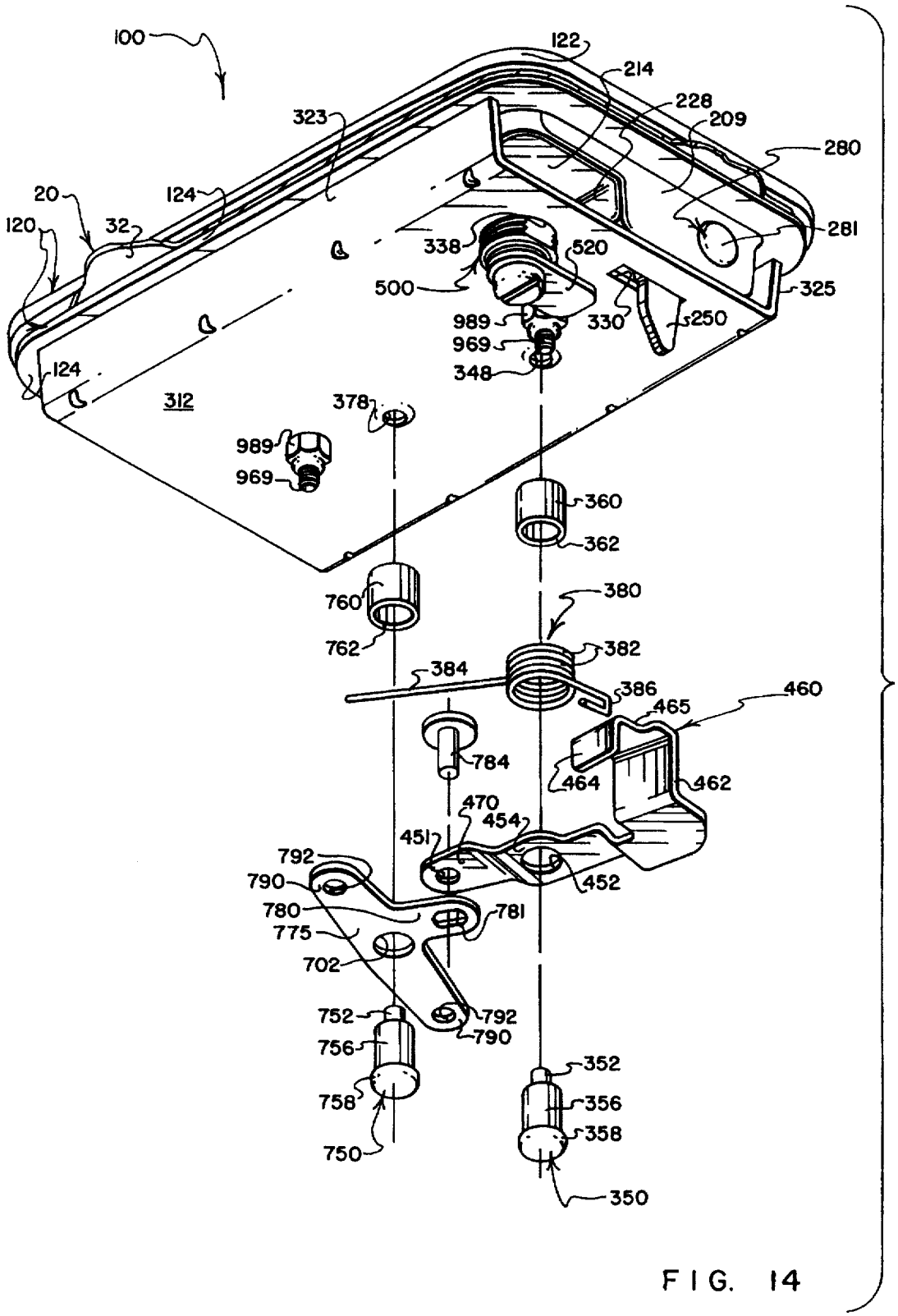
FIG. 14 is an exploded rear perspective view showing selected components of the operating mechanism of FIGS. 1–13, with some components separated so as to be depicted individually, and with other components shown assembled.

Three modular assemblies 200, 300, 500 form the operating mechanism 100. Referring to FIGS. 11 and 12, a pan-shaped housing 210, a paddle-shaped handle 240, a hinge pin 280, and a torsion coil spring 290 comprise what will be referred to as a "front mountable modular assembly" or "handle and housing assembly" 200. Referring to FIGS. 13 and 14, a mounting bracket 310, an operating arm 450, and a T-shaped lever-type link 700 (having opposed end regions 790 that each connect with a separate one of the links 800) comprise what will be referred to as a "rear mountable modular assembly" or "bracket, latch and linkage assembly" 300. Referring to FIGS. 11, 12 and 14, a "third modular assembly" takes the form of a conventional, commercially available, "key operated cam lock assembly" 500 that can be operated by a suitably configured key 510 (see FIGS. 8 and 10 wherein the bow of the key 510 is shown projecting forwardly from the cam lock assembly 500).

Figure 5:
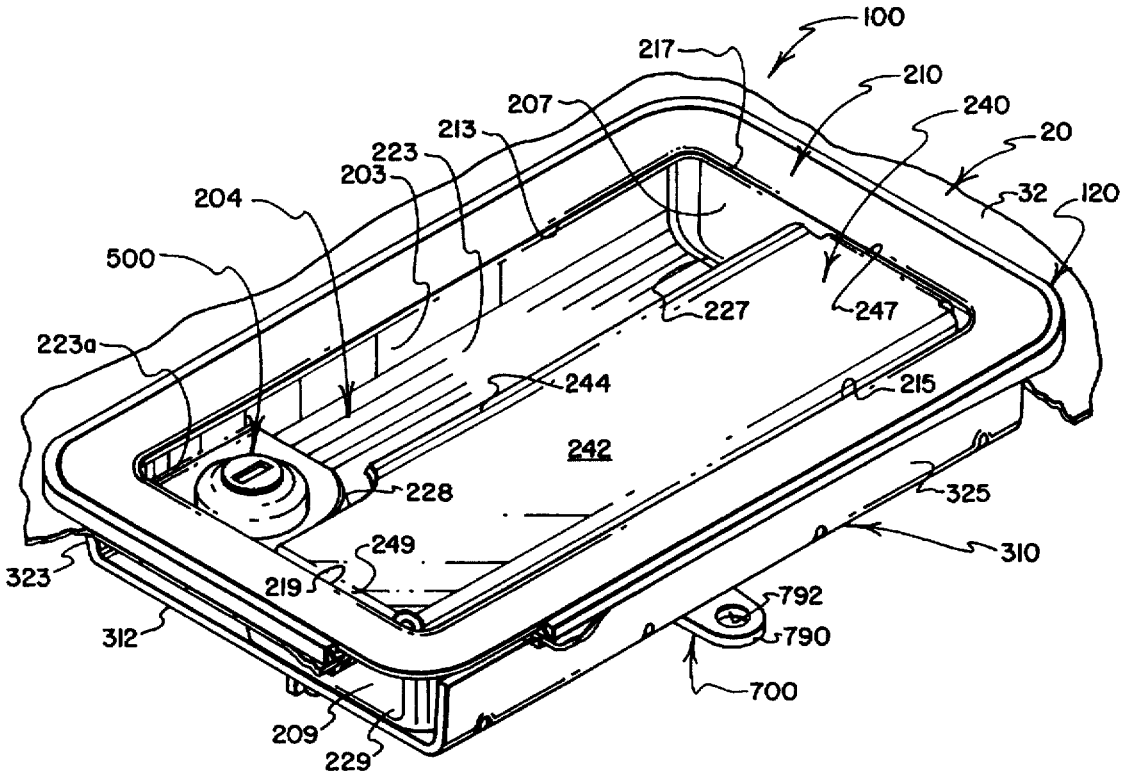
FIG. 5 is a perspective view of the flush-mountable operating mechanism that is used with the first and second lock embodiments shown mounted on a slightly curved portions of a closure.
Figure 6:
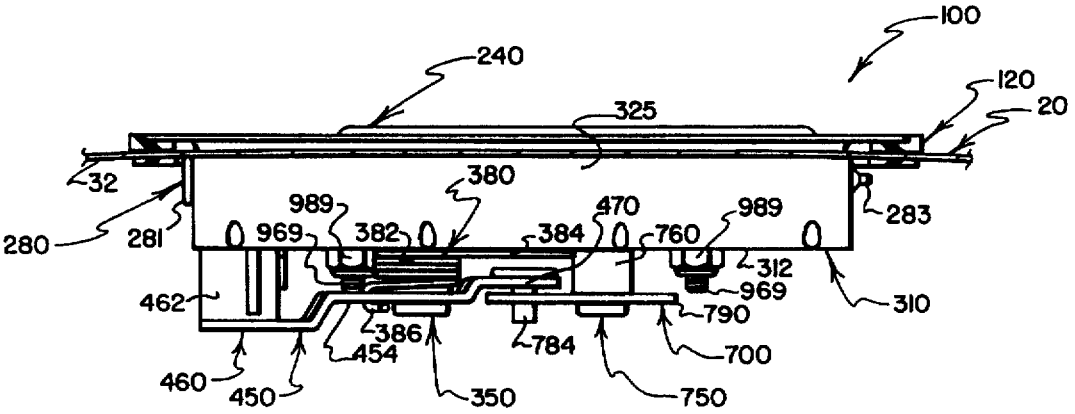
FIG. 6 is a side elevational view thereof.

Turning to features of the "front mountable modular assembly" or "handle and housing assembly" 200, and referring to FIGS. 5, 11 and 12, the pan-shaped housing 210 is a generally rectangular metal stamping having a perimetrically extending, substantially flat mounting flange 202 which surrounds a forwardly facing recess 204. Opposed, relatively long side walls 203, 205, and opposed, relatively short end walls 207, 209 are joined by small radius bends 213, 215, 217, 219 to the flat mounting flange 202.

A majority of the recess 204 is relatively deep, and is closed by a main back wall portion 212 that is substantially flat. A corner region of the recess 204 located near the juncture of the side and end walls 203, 209 is more shallow, and is closed by a minor back wall portion 214 that also is substantially flat. Relatively small radius bends **223*a* (FIG. 5), 229*a* (FIGS. 11–12) join portions of the side and end walls 203, 209 to the minor back wall portion 214. A curved wall 228 joins the minor back wall portion 214 to the main back wall portion 212, with small radius bends being provided where the curved wall 228 joins with the back wall portions 212, 214. Referring variously to FIGS. 5, 11 and 12, relatively small radius bends 225, 227, 229 join portions of the side and end walls 205, 207, 209 to the main back wall portion 212. A relatively larger radius bend 223 joins portions of the side wall 203 to the main back wall portion 212**.

Referring to FIG. 12, a main back wall opening 230 is formed through the main back wall portion 212; and, a lock mount opening 238 is formed through the minor back wall portion 214. The main back wall opening 230 is elongate, generally rectangular, is spaced a short distance from the housing end wall 229, and extends parallel to the housing end wall 229. The lock mount opening 238 is generally circular except for two flats 239 formed along opposite sides thereof.

Referring principally to FIGS. 11 and 12, the paddle-shaped handle 240 has a generally rectangular front wall 242 with a forwardly-turned lip 244 formed along one edge. Rearwardly-turned end flanges 247, 249 border opposite ends of the rectangular front wall 242 and extend alongside the housing end walls 207, 209, respectively. The end flange 249 has an inwardly-turned extension 248 that parallels the front wall 242 of the handle 240, and that carries a rearwardly projecting tab-like formation 250 that extends through the main back wall opening 230. Referring to FIG. 12, an optional, generally rectangular gasket 259 may be provided to surround portions of the projection 250 at a location adjacent the back wall opening 230.

Referring to FIG. 12, the hinge pin 280 extends through aligned holes 260 that are formed through the end walls 207, 209 of the pan-shaped housing 210, and through aligned holes 270 that are formed through the rearwardly-turned flanges 247, 249 of the paddle-shaped handle 240 to pivotally mount the handle 240 on the housing 210. A head 281 is formed on one end of the pin 280. While the opposite end of the pin initially is pointed (as depicted in FIG. 12) to facilitate assembly, once the pin 280 has been inserted through the holes 260, 270 to pivotally mount the handle 240 on the housing 210, a crimp 283 is formed (see FIG. 7) to prevent removal of the pin 280 from the holes 260, 270.

Figure 8:
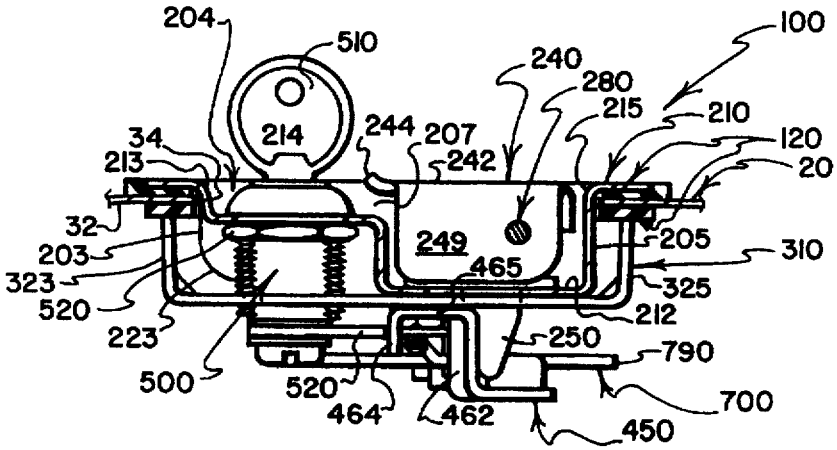
FIG. 8 is a sectional view as seen from a plane indicated by a line 8—8 in FIG. 7, but with a key inserted in the key-operated lock assembly.

Referring to FIGS. 11 and 12, the torsion coil spring 290 has a coiled central region 292 that extends loosely about the hinge pin 280 at a location between the rearwardly-turned flanges 246 of the handle 240, and has opposed end regions 294, 296 that engage the back wall 212 and the handle 240, respectively, to bias the handle 240 away from its "extended" or "operated" position (see FIG. 10) toward its "nested" or "non-operated" position (see FIGS. 5, 8 and 11).

Figure 9:
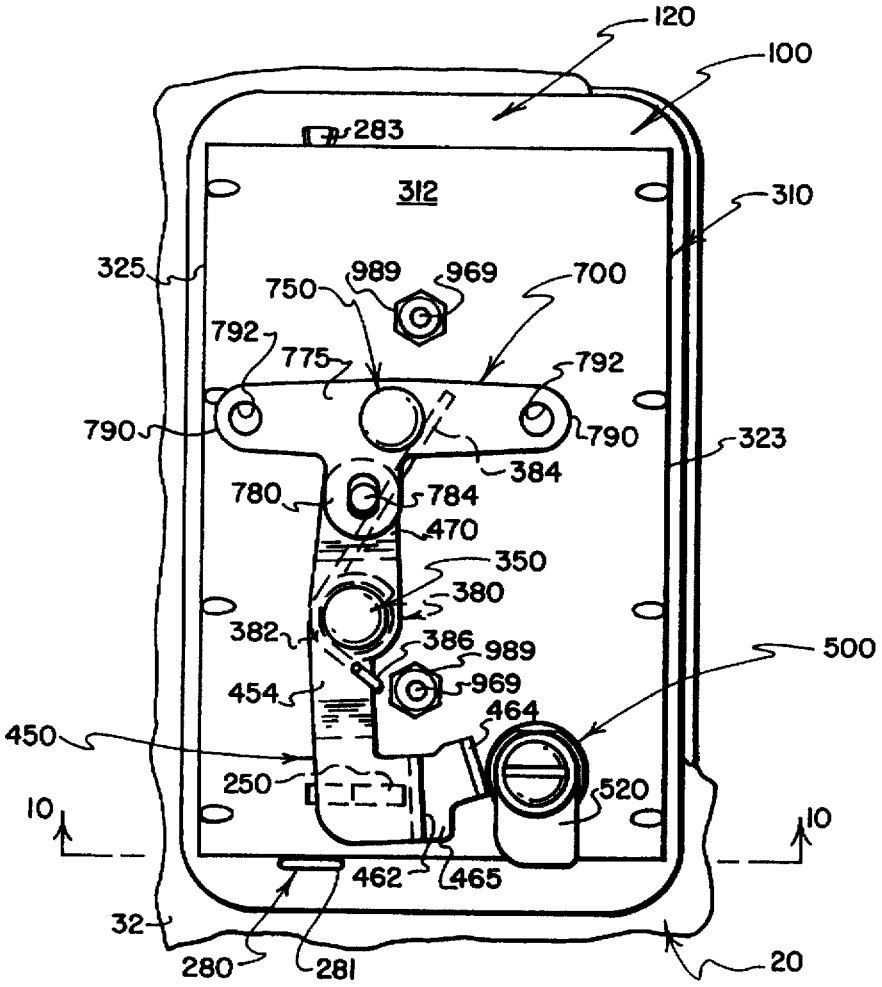
FIG. 9 is a bottom plan view similar to FIG. 7 but with the cam of the lock assembly in its unlocked position, and with an operating handle of the operating mechanism in an operated position that causes an operating arm to pivot a T-shaped lever for moving elongate links of the type used with the first and second lock embodiments.
Figure 10:
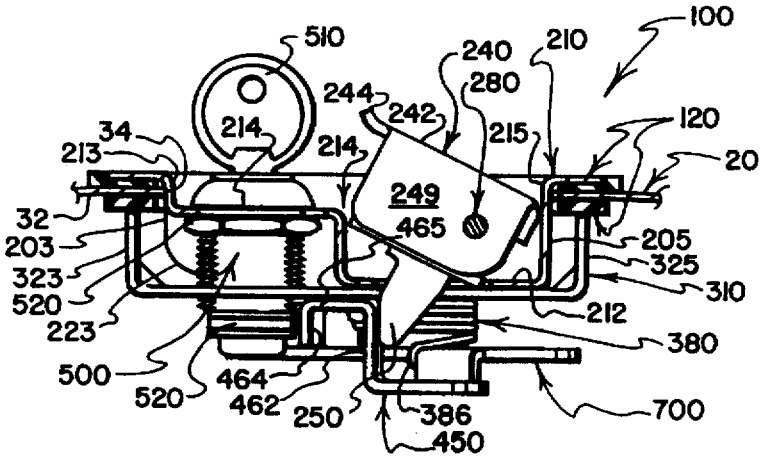
FIG. 10 is a sectional view as seen from a plane indicated by a line 10—10 in FIG. 9.

When the operating handle 240 is moved away from its nested, non-operated position toward its extended, operated position (by pivoting about the axis of the pin 280), the rearwardly extending handle tab projection 250 is caused to move within the back wall opening 230 (from a normal or "first" position that is depicted in FIG. 8 to a "second" position that is depicted in FIG. 10). As will be explained shortly, this movement of the tab 250 within the confines of the back wall opening 230 causes the operating arm 450 to move from a normal or "primary" position of the operating arm 450 (depicted in FIGS. 7 and 8) to a "secondary" position of the operating arm 450 (depicted in FIGS. 9 and 10).

Turning now to features of the "rear mountable modular assembly" or "bracket, latch and linkage" assembly 300, and referring to FIGS. 11–14, the mounting bracket 310 has a relatively flat, generally rectangular-shaped central region 312 with a forwardly turned side flanges 323, 325 configured to extend along the full lengths of the housing side walls 203, 205 when the front and rear modules 200, 300 are assembled).

An elongate, generally rectangular opening 330 is formed through the flat central portion 312 of the mounting bracket 310 to align with the main back wall opening 230 when the mounting bracket 310 is mounted together with the handle and housing assembly 200 on the closure 20—which alignment is provided to enable the the rearwardly projecting formation 250 of the handle 240 to extend through the opening 330 to engage the operating arm 450. A feature that is provided by the closely spaced, aligned housing and mounting bracket openings 230, 330 is that they cooperate to protectively enshroud the rearwardly projecting formation 250 to prevent it from bending or breaking either during normal service or as the result of tampering.

Optionally formed through the flat central portion 312 of the mounting bracket 310 is a circular opening 338 that is located to align with the lock mounting opening 238 of the pan-shaped housing 210 to permit the lock assembly 500 to pass therethrough in a close fit. A feature that is provided by the close fit of the circular opening 338 about body portions of the lock assembly 500 is that the material of the mounting bracket 310 that extends about the opening 338 will help to reinforce and rigidify the mounting of the lock assembly 500 in the lock mounting opening 238 to prevent damage from occurring due either to extensive normal service or as the result of tampering or forcing of the operating mechanism 100.

Referring to FIG. 13, tapered holes 348, 748 are formed through the flat central portion 312 of the mounting bracket 310 to receive reduced diameter end regions 352, 752 of mounting posts 350, 750, respectively. The mounting posts 350, 750 are rigidly attached to the mounting bracket 310 by deforming and expanding the reduced diameter end regions 352, 752 to form an enlarged heads 354, 754 that substantially fill the tapered holes 348, 748, as is depicted in FIGS. 11 and 12.

Referring to FIGS. 13 and 14, the mounting posts 350, 750 have generally cylindrical central regions 356, 756 that extend rearwardly to where enlarged heads 358, 758 are formed, respectively. Sleeves 360, 760 are mounted in a slip fit on the central regions 356, 756 and extend rearwardly from the flat central wall 312 of the mounting bracket 310 to define ends 362, 762 that are spaced short distances from the head formations 358, 758.

Figure 7:
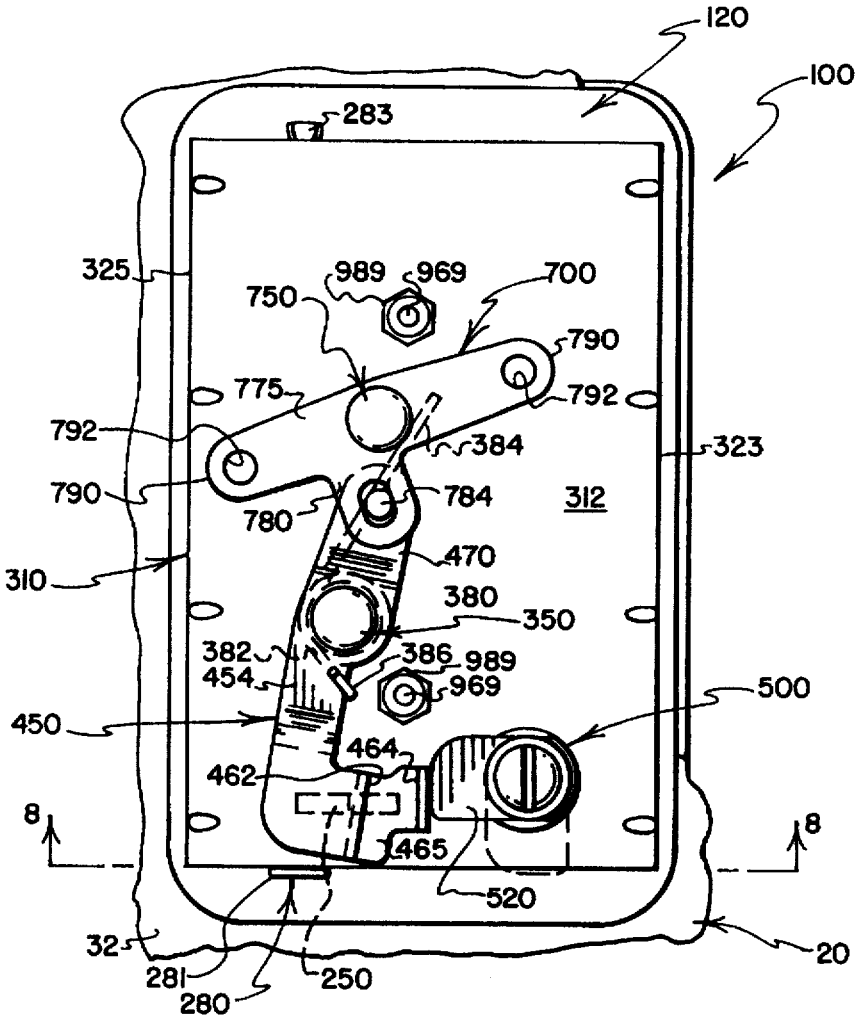
FIG. 7 is a bottom plan view thereof, with relatively movable components positioned as is depicted in FIGS. 5 and 6, with a cam of a key-operated lock assembly shown in solid lines in its locked position and shown in phantom in its unlocked position.

The operating arm 450 has a mounting hole 452 that is sized to receive the central region 356 in a slip fit that will permit the operating arm 450 to pivot smoothly relative to the mounting post 350 between the "primary" position of the operating arm 450 which is depicted in FIG. 7 and the "secondary" position of the operating arm 450 which is depicted in FIG. 9. The operating arm 450 is mounted on the mounting post 350 at a location between the head formation 358 and the end 362 of the sleeve 360, with the central region 356 extending through the mounting hole 452.

In similar fashion, the T-shaped lever-type link 700 has a mounting hole 702 that is sized to receive the central region 756 in a slip fit (that will permit the link 700 to pivot smoothly relative to the mounting post 750 between the "first" position of the line 700 which is depicted in FIG. 7 and the second position of the link 700 which is depicted in FIG. 9). The T-shaped link 700 is mounted on the mounting post 750 at a location between the head formation 758 and the end 762 of the sleeve 760, with the central region 756 extending through the mounting hole 702.

Referring still to FIGS. 13 and 14, a torsion coil spring 380 has coils 382 located between opposite ends 384, 386. The coils 382 extend about the sleeve 360 to mount the spring 380 on the mounting post 350 at a location between the flat wall 312 of the mounting bracket 310 and the operating arm 450. Referring to FIGS. 7 and 9, the spring end 384 extends away from the mounting post 350 to engage sleeve 760 that is carried on the mounting post 750, while the spring end 386 engages the operating arm 450 to bias the operating arm 450 (in a clockwise direction as viewed in FIGS. 7 and 9 away from the "secondary" position of the operating arm 450 depicted in FIG. 9 toward the "primary" position of the operating arm 450 depicted in FIG. 7).

The T-shaped lever-type link 700 has a central leg or "stem" 780 that extends away from a "bar" 775 of the link 700 (the "bar" 775 and the "stem" 780 cooperate to give the link 700 its "T" shape). A connecting pin 784 extends through aligned holes 451, 701 of the operating arm 450 and the link 700 to provide a pivotal connection therebetween. A pair of connecting pins 785 (see FIGS. 2 and 4) extend similarly through holes 792 formed in the end regions 790 of the "bar" 775 and through aligned holes (not shown) formed in the links 800 to pivotally connect the T-shaped link 700 to the elongate links 800.

Because the T-shaped lever-type link 700 is pivotally connected to the operating arm 450 by the connecting pin 784, and because the elongate links 800 are pivotally connected to the T-shaped lever-type link 700 by the connecting pins 785, the action of the torsion coil spring 380 in biasing the operating arm 450 (in a clockwise direction as viewed in FIGS. 7 and 9 away from the "secondary" position of the operating arm 450 depicted in FIG. 9 toward the "primary" position of the operating arm 450 depicted in FIG. 7) also causes the T-shaped lever-type link 700 to be biased (in a counterclockwise direction as viewed in FIGS. 7 and 9 away from the "second" position of the link 700 depicted in FIG. 9 toward the "first" position of the link 700 depicted in FIG. 7), and also causes the elongate links 800 to be biased in opposed directions (away from each other, in directions indicated by arrows 810 in FIGS. 1–4).

However, when the operating arm 450 is pivoted about its mounting post 350 in a counterclockwise direction (as viewed in FIGS. 7 and 9 away from the "primary" position of the operating arm 450 depicted in FIG. 7 toward the "secondary" position of the operating arm 450 depicted in FIG. 9), the pivotal interconnection of the operating arm 450 with the T-shaped lever-type link 700, and the pivotal interconnection of the T-shaped link 700 with the elongate links 800 causes the T-shaped link 700 to be pivot about its mounting post 750 (in a clockwise direction as viewed in FIGS. 7 and 9 away from the "first" position of the link 700 depicted in FIG. 7 toward the "second" position of the link 700 depicted in FIG. 9), and also causes the elongate links 800 to execute "unlatching" movements (toward each other, in directions indicated by arrows 820 in FIGS. 1–4).

Referring again to FIGS. 13 and 14, the operating arm 450 has a rather complex configuration that includes a substantially flat, elongate central region 454 (through which the mounting hole 452 is formed) that extends between one end where a U-shaped formation 460 is provided, and an opposite end 470, through which the hole 451 is formed.

The U-shaped formation 460 is defined by first and second forwardly-rearwardly extending legs 462, 464 that are interconnected near their forward ends by a base leg 465. The U-shaped formation 460 serves the dual functions 1) of providing the leg 462 to be engaged by the rearwardly projecting formation 250 of the handle 210 (so that the operating arm 450 will be moved by the rearwardly projection formation 250 when the handle 240 pivots about its mounting pin 280), and 2) of providing the leg 464 to be selectively; engaged and disengaged by a cam 520 of the lock mechanism 500 (to "lock" and "unlock" the operating mechanism 100 in response to operation by the key 510 of the lock assembly 500).

The operating mechanism 100 can, of course, be used with a wide variety of commercially available latch assemblies—for example the latch assemblies 1100 that are sold by the Eberhard Manufacturing Co. division of The Eastern Company, Strongsville, Ohio 44136 under the product designations 4974-52. Referring to FIG. 15, the latch assembly 1100 has a welded casing 1120 that houses portions of the latch bolt 1110 together with a compression coil spring 1130 that biases the latch bolt 1110 toward an extended position that is depicted in FIGS. 1, 2 and 15 wherein the latch bolt 1110 engages a conventional strike 1150 that is carried by the door frame portions 22. When the link 800 is moved in the direction of the arrow 820 to retract the latch bolt 1110, the latch bolt 1110 disengages the strike 1150, as will be readily understood by those who are skilled in the art.

Figure 16:
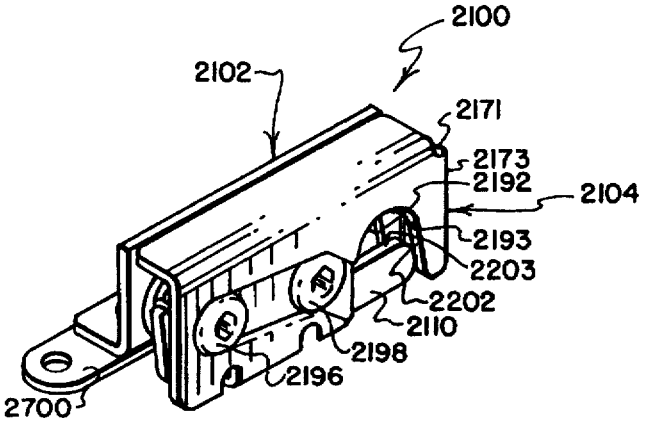
FIGS. 16 and 17 are perspective views taken from different directions of one of the rotary latch assemblies of the second lock embodiment.
Figure 17:
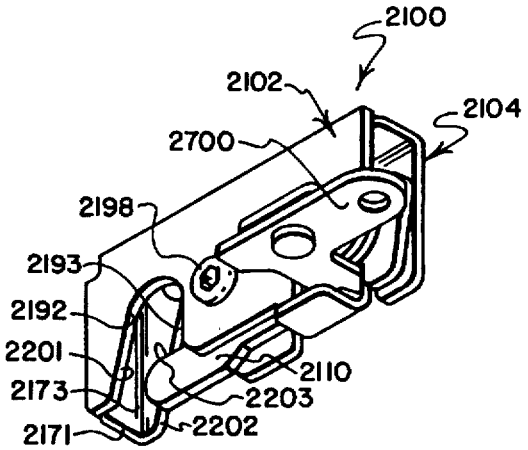
Figure 18:
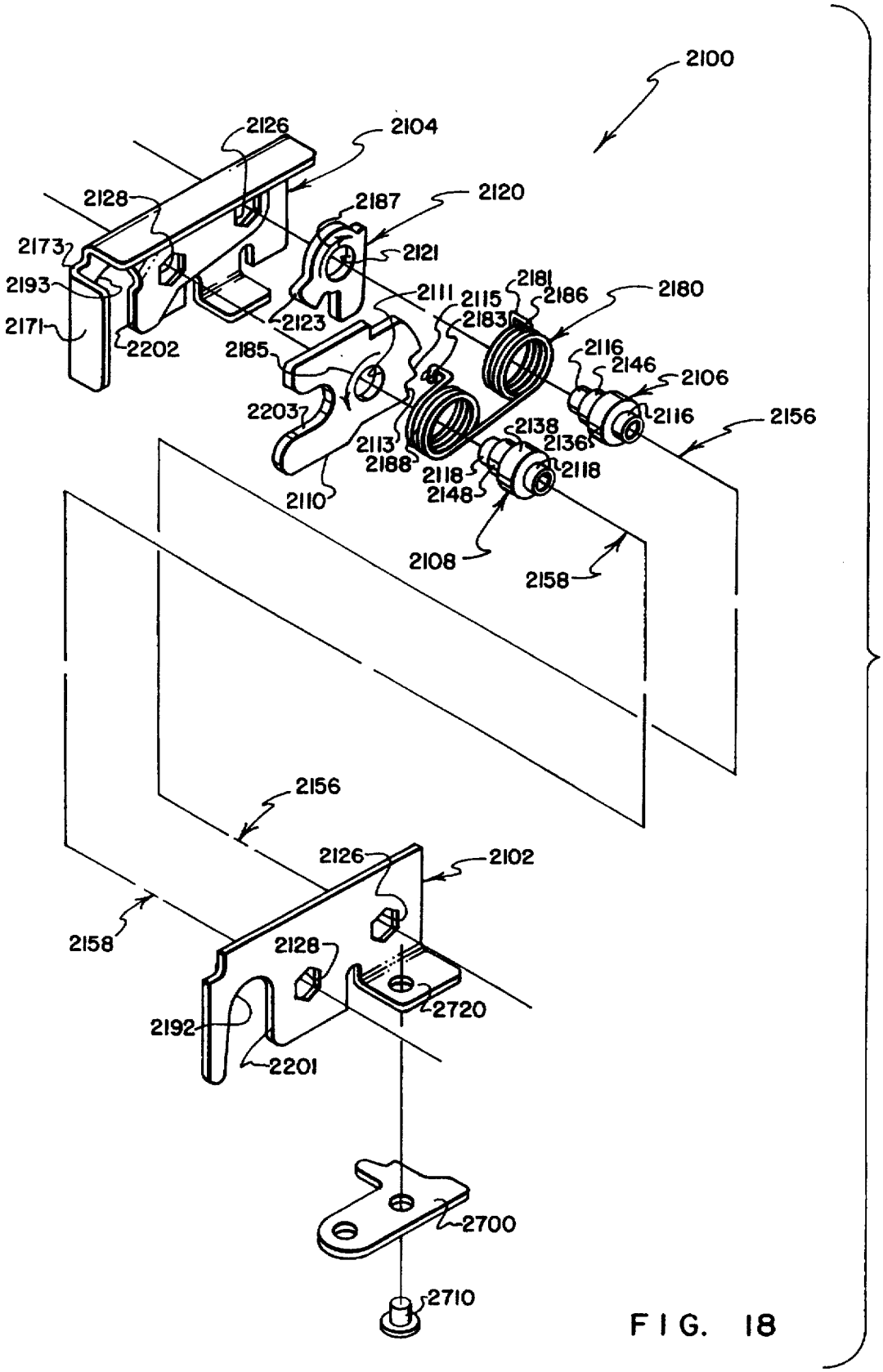
FIG. 18 is an exploded perspective view showing components of one of the rotary latch assemblies of the second, lock embodiment; and, FIGS. 19, 20 and 21 are sectional views, on an enlarged scale, as seen from a plane indicated by a line A—A in FIG. 4, and depicting somewhat schematically a sequence of three steps by which a suitably configured strike is received by one of the rotary latches of the second embodiment, with FIG. 19 showing the latch "unlatched" and the strike not yet engaging the latch, with FIG. 20 showing the strike being received by the latch and showing a preliminary latching orientation of latch components, and with FIG. 21 showing a fully latched configuration of the strike and latch components.
Figure 19:
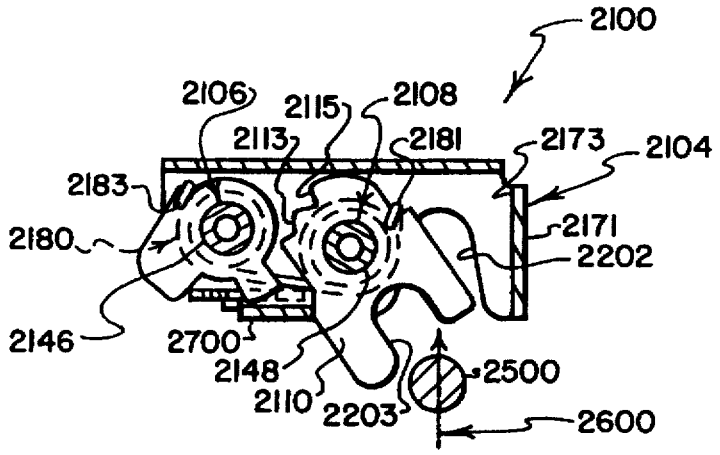
Figure 20:
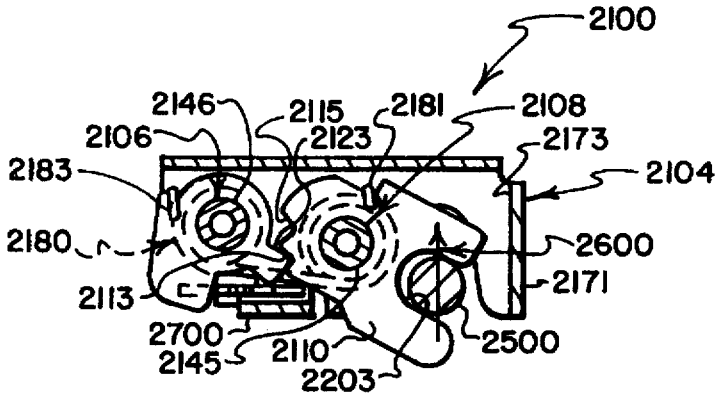
Figure 21:
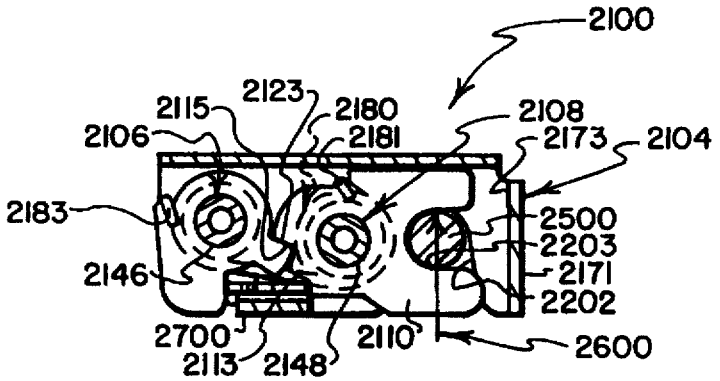

If the operating mechanism 100 is to be used with a pair of rotary latches, the rotary latches preferably are of a type that incorporate features of the inventions of the referenced Parent Cases—together with an improvement feature that is added as a further aspect of the present invention—such as the rotary latches 2100 that are depicted in FIGS. 16–18. FIGS. 19–21 also are provided to schematically illustrate how a typical one of the latches 2100 performs during three stages that occur as a suitably configured strike formation 2500.

A "suitably configured strike formation" 2500 for use with one of the rotary latches 2100 (referred to hereinafter simply as a "strike 2500") typically is a generally cylindrical part of a metal member (not shown) that is suitably attached to structure such as the door frame 22 and located so as to be engaged by and received in one of the latches 2100 (when the closure 20 is closed) in a manner that will be described shortly, so that the strike 2500 is releasably retained by the rotary latch assembly 2100. If more detail regarding what constitutes a "suitably configured strike formation" is desired, more extensive disclosure is provided in the referenced Parent and Sister Cases, the disclosures of which are incorporated herein by reference.

Referring to FIG. 18, each of the rotary latch assemblies 2100 has what will be referred to as a "housing" that consists of opposed first and second "housing side plates" 2102, 2104. The side plates 2102, 2104 are held in spaced, parallel relationship by first and second spacers or bushings 2106, 2108.

The first and second bushings 2106, 2108 are tubular (i.e., they have hollow interiors), and have reduced diameter end regions 2116, 2118 that are sized to be received in a slip fit within hex-shaped holes 2126, 2128 that are formed in the side plates 2102, 2104, respectively. To securely retain the hollow, reduced diameter end regions 2116, 2118 in the hex-shaped holes 2126, 2128 (to thereby rigidly interconnect the housing side plates 2102, 2104), the end regions 2116, 2118 are deformed and enlarged to form heads 2196, 2198 (see FIGS. 16 and 17) that have hollow interiors that tend to be of slightly hex shape after the end regions 2116, 2118 have been properly deformed to fully engage the sides of the hex-shaped holes 2126, 2128. Because the holes 2126, 2128 are hex-shaped, and because the hollow end regions 2116, 2118 are expanded (during formation of the heads 2196, 2198) to fully fill the hex-shaped holes 2126, 2128, good, secure, rotation-resistant connections are formed that rigidly interconnect the side plates 2102, 2104 and that resist loosening and rotation of the bushings 2106, 2108 relative to the side plates 2102, 2104.

Referring still to FIG. 18, the bushings 2106, 2108 are generally cylindrical, and provide stepped central regions that have relatively large diameter portions 2136, 2138 and relatively medium diameter portions 2146, 2148, respectively. The end and central regions 2116, 2136, 2146 of the bushing 2106 are concentric about a first transversely extending axis that is designated by the numeral 2156. The end and central regions 2118, 2138, 2148 of the bushing 2108 are concentric about a second transversely extending axis that is designated by the numeral 2158. Optional internal threads (not shown) may be formed within hollow interiors of the bushings 2106, 2108 to permit threaded fasteners of suitable size (not shown) to be connected to the rotary latch assemblies 2100 (should this be desirable, for example as an aid in mounting the latch assemblies 2100 on the closure 20).

The side plates 2102, 2104 define aligned first and second U-shaped notches 2201, 2202, respectively, that are oriented so that, as the closure 20 (on which the rotary latch assemblies 2100 are mounted) is moved toward its closed position, the resulting relative movement of a separate one of the strikes 2500 toward each of the latch assemblies 2100 (in the direction indicated by arrows 2600 in FIGS. 19–21) will cause each of the generally cylindrical strikes 2500 to be received in the first and second U-shaped notches 2201, 2202 of a separate one of the latch assemblies 2100. As one of the strikes 2500 enters the first and second U-shaped notches 2201, 2202, it also is received in a third U-shaped notch 2203 defined by the rotary jaw 2110 of the latch assembly 2100—and the third U-shaped notch 2203 functions in concert with the first and second U-shaped notches 2201, 2202 to receive and latchingly retain the strike 2500 in the notches 2201, 2202, 2203 when the closure 20 is closed.

A feature of the preferred practice of the present invention resides in the utilization of the second U-shaped notch 2202 (either alone or in concert with the first U-shaped notch 2201) to define a strike engagement surface (or surfaces) that is (are) directly engageable by the strike 2500. If the first and second U-shaped notches 2201, 2202 are identically configured and positioned to extend in congruent alignment, a pair of congruently aligned strike engagement surfaces 2192, 2193 (see FIG. 17) are defined by the notches 2201, 2202—which are engageable by the strike 2500 as the strike 2500 moves into and is latchingly retained within the U-shaped notches 2201, 2202. If, on the other hand, the first U-shaped notch 2201 is configured such that it is wider than the second U-shaped notch 2202 (so that the surfaces that define the first notch 2201 are positioned such that they cannot physically engage the strike 2500), the only strike engagement surface that will be defined by either of the notches 2201, 2202 is the strike engagement surface 2193 that is defined by the second U-shaped notch 2202.

By always ensuring that the strike engagement surface 2193 is defined by the second U-shaped notch 2202 (regardless of whether an additional strike engagement surface 2192 is defined by the first U-shaped notch 2201), advantage will always be taken of the close proximity presence to the second notch 2202 (and to the strike engagement surface 2193) of a transversely extending reinforcing flange 2171 that is formed integrally with the second side plate 2104 near one end thereof. A tight radius bend 2173 connects the flange to a narrow portion 2175 (see FIGS. 1 and 2) of the second side plate 2104 that extends along one side of the second notch 2202 (and that defines the strike engagement surface 2193). The close proximity presence of the transversely extending flange 2171 and the bend 2173 to the second notch 2202 (and to the strike engaging surface 2193 that is defined by the second notch 2202) strengthens and rigidifies the second housing side plate 2104 in the critical area adjacent the strike engaging surface 2193.

While the second U-shaped notch 2202 could be configured such that it is wider than the first U-shaped notch 2201 (whereby the only strike engagement surface that would be defined by either of the notches 2201, 2202 is the strike engagement surface 2192 that is defined by the first U-shaped notch 2101), this option does not conform to the preferred practice of the present invention unless the first side plate 2102 is provided with a transversely extending flange (not shown) that is substantially identical to the depicted flange 2171, but which extends from the first side plate 2102 toward the second side plate 2104 to bridge the space therebetween (instead of extending from the second side plate 2204 toward the first side plate 2102 to bridge the space therebetween, as does the depicted flange 2171).

Referring to FIG. 18, housed between the side plates 2102, 2104 are the rotary jaw 2110 and the rotary pawl 2120. The rotary jaw 2110 has a mounting hole 2111 that receives the bushing diameter 2148 therein in a slip fit to mount the rotary jaw 2110 on the bushing 2108 for limited angular movement about the transversely extending axis 2158. The rotary pawl 2120 has a mounting hole 2121 that receives the bushing diameter 2146 therein in a slip fit to mount the rotary pawl 2120 on the bushing 2106 for limited angular movement about the transversely extending axis 2156.

Also housed between the side plates 2102, 2104 is a torsion coil spring 2180 that has a first coil 2186 that extends about the diameter 2136 of the bushing 2106, and a second coil 2188 that extends about the diameter 2138 of the bushing 2108. An end 2181 of the spring 2180 engages the rotary jaw 2110 for biasing the rotary jaw 2110 in a direction of angular movement about the axis 2158 that is indicated by an arrow 2185. An opposite end 2183 of the spring 2180 engages the rotary pawl 2120 for biasing the rotary pawl 2120 in a direction of angular movement about the axis 2156 that is indicated by an arrow 2187.

Referring to FIGS. 18–20, the rotary jaw 2110 and the rotary pawl 2120 are provided with engageable formations 2113, 2123, respectively, that cooperate to "preliminarily latch" the rotary jaw 2110 in engagement with the strike 2500 (see FIG. 20) after the strike 2500 has moved only a short distance into the aligned first and second U-shaped notches 2201, 2202 during movement of the closure 20 toward its closed position.

Referring to FIG. 21, the rotary jaw 2110 and the rotary pawl 2120 also are provided with engageable formations 2115, 2123, respectively, that cooperate to "fully latch" the rotary jaw 2110 in engagement with the central region 56 of the strike 2500 after the strike 2500 has moved as far as it is going to move into the aligned first and second U-shaped notches 2201, 2202 as the closure 20 is moved to its fully closed position. When the engageable formations 2115, 2123 are engaged (as is depicted in FIG. 21), the rotary jaw 2110 is prevented by the rotary pawl 2120 from executing unlatching movement until the rotary pawl 2120 is rotated about the axis 2156 to a pawl-releasing position wherein the engageable formations 2115, 2123 disengage to permit the rotary jaw 2110 to rotate away from its fully latched position toward its unlatched position wherein the strike 2500 is free to move out of the third U-shaped notch 2203 that is defined by the rotary jaw 2110. This type of pawl-controlled jaw latching action is well known to those who are skilled in the art, and is further illustrated and described in a number of the patents that are identified above.

To move the rotary pawl 2120 in opposition to the action of the torsion coil spring 2180 (i.e., in a direction opposite the arrow 2187) from a pawl-retaining position (depicted in FIG. 21) to a pawl-releasing position (depicted in FIG. 19), a release lever 2700 is pivotally mounted by a rivet 2710 (see FIG. 18) on a right-angle projection 2720 of the housing side plate 2102—which is effected by movement of an associated one of the links 800 (each of the links 800 connects with the release lever 2700 of a separate one of the rotary latch assemblies 2100).

Movement of the links 800 in the direction of the arrows 820 to effect "unlatching" of the rotary latch assemblies 2100 takes place in response to movement of the handle 240 from its normal non-operated position shown in FIGS. 5 and 8 to its operated position shown in FIG. 10. When the operated handle 240 is released, it returns to its non-operated position under the influence of the spring 290, hence the rearward extending projection 250 no longer remains in the "second" position of FIG. 10 where it holds the operating arm 450 in its "secondary" position of FIG. 9. As the projection 250 returns to the "first" position of FIGS. 5 and 8, the operating arm 450 is caused to return to its "primary" position of FIG. 7 due to the biasing action of the spring 380, hence the links 800 return to their normal positions of FIGS. 2 and 3 (due at least in part to the biasing action of the operating arm spring 380) whereby the rotary latches 2100 are ready to be slammed into latching engagement with strikes 2500.

So long as the rotary jaw 2110 of the rotary latch assembly 2100 in its unlatched position (depicted in FIG. 19), the rotary jaw 2110 always can be slammed into latching engagement with the strike 2500. This is true regardless of how the relatively movable components of the operating mechanism 100 may be positioned. As the rotary jaw 2110 receives the strike 2500 within its U-shaped notch 2203, and as the strike 2500 moves into the aligned first and second U-shaped notches 2201, 2202 of the housing side plates 2102, 2104, the strike 2500 becomes cooperatively confined by the combined action of the first, second and third notches 2201, 2202, 2203. When the strike 2500 reaches the position that is depicted in FIG. 20, the rotary pawl 2120 and the rotary jaw 2110 become "preliminarily latched" (i.e., the engagement formations 2113, 2123 engage to prevent unlocking of the rotary jaw 2110). When the strike 2500 reaches the fully latched position depicted in FIG. 21, the engagement formations 2115, 2123 engage to fully lock the closure 20 in its closed position.

Referring to FIGS. 11 and 12, to securely connect the "handle and housing assembly" or "front module" 200 to the "bracket, latch and linkage assembly" or "rear module" 300 (so that the assemblies 200, 300 will be securely retained in place on the closure 20), threaded studs 969 are provided that project rearwardly from the back wall 212 of the pan-shaped housing 210 through openings 979 that are formed through the flat wall 312 of the mounting bracket 310, and lock nuts 989 are threaded onto the studs 969 and tightened in place so that the gasket set 120 that extends about the mounting opening 34 is compressed to form a weather tight seal as the front and rear assemblies are securely connected by the fasteners 969, 989. By this arrangement, the assemblies 200, 300 are quickly, easily and yet securely connected and fastened in place on the closure, with proper alignment and registry of the assemblies 200, 300 being ensured.

Referring to FIGS. 11 and 12, the key-operated cam lock assembly 500 is a commercially purchased assembly available from a wide variety of sources, and is selected to provide a quarter-turn for the cam 520, with the key 510 (see, for example, FIGS. 8 and 10) preferably being removable in both the "locked" position of the cam 520 (depicted in FIG. 7) and the "unlocked" position of the cam 520 (depicted in FIG. 9). Referring to FIG. 12, the assembly 500 has a housing 530 with threaded exterior portions 532, and with opposed flat surfaces 539 (only one of which is shown in FIG. 12) that engage the flats 239 of the lock mount opening 238 to prevent the housing 530 from rotating relative to the pan-shaped housing 210. A nut 540 is threaded onto the threaded exterior portions 532 of the body 530 to hold the lock assembly 500 in place on the pan-shaped housing 210.

So long as the key-locking assembly 500 positions the cam 520 in its "unlocked" position, as is depicted in FIG. 9, pivotal movement of the operating arm will not be impeded by the cam 520—hence, the operating handle 240 can be pivoted out of its nested, non-operated position (shown in FIG. 8) to its extended, operated position (shown in FIG. 10) to cause the tab 250 to pivot the operating arm to pivot the rotary pawl 420 away from its normal jaw-retaining position (shown in FIG. 21) toward its jaw-releasing position (shown in FIG. 19) to release the pawl formation 2123 from engaging either of the jaw formations 2113, 2115, whereupon the rotary jaw 2120 pivots under the influence of the spring 2180 away from its latched position (shown in FIG. 21) to its unlatched position (shown in FIG. 19) to release the strike 2500.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable, handle-operable latch operating mechanism for mounting on a closure and for being connected by a first linkage to a first remotely located closure-mounted latch assembly that is engageable with a first strike, and by a second linkage to a second remotely located latch assembly that is engageable with a second strike for releasably retaining the closure in a closed position, comprising:

a) flush-mountable front assembly means for mounting as a first modular assembly on a closure adjacent a mounting opening that is formed through a front wall of the closure, including:

i) first housing means including a pan-shaped housing for mounting on the closure adjacent the mounting opening, including a one-piece housing that defines:

A) mounting flange means for defining a front wall of the pan-shaped housing, including a mounting flange that is configured 1) to extend perimetrically about the closure's mounting opening, 2) to closely overlie portions of a front surface of the closure's front wall that extend perimetrically about the mounting opening, and 3) to be clamped toward engagement with said portions of the closure's front surface to substantially flush-mount the pan-shaped housing on the closure;

B) side walls and a back wall that cooperate to define a forwardly-facing recess, 1) with the side walls being configured to extend forwardly and rearwardly through the closure's mounting opening when the mounting flange closely overlies said portions of the closure's front surface, 2) the side walls having front portions that join smoothly with and are perimetrically surrounded by the mounting flange, 3) the side walls having rear portions that join smoothly with portions of the back wall, 4) with said portions of the back wall being configured to extend substantially parallel to the front wall of the pan-shaped housing, 5) with said portions of the back wall having a front surface that faces forwardly into the recess and a rearwardly-facing back surface on the opposite side thereof, and 6) with a main back wall opening formed through said portions of the back wall;

ii) handle means including an operating handle that is at least partially nested within the recess, and that is connected to the first housing means for movement relative to the pan-shaped housing between a non-operated position and an operated position;

iii) projection means connected to the handle and extending rearwardly through the opening formed in the back wall for being moved by movement of the handle 1) such that, when the handle is in the non-operated position, the projection means is caused by its connection to the handle to be in a first position, such that, 2) when the handle is moved from the non-operated position to the operated position, the projection means is caused by such movement to move from the first position to a second position, and such that, 3) when the handle is moved from the operated position to the non-operated position, the projection means is caused by such movement to move from the second position to the first position;

b) rear assembly means for mounting as a second modular assembly on the closure, for being connected to the front assembly means to clampingly draw the mounting flange toward engagement with said portions of the closure's front surface to securely mount the rotary latch on the closure, including:

i) mounting bracket means including a mounting bracket having a rear wall for overlying at least a portion of the back surface of the back wall of the pan-shaped housing, for bridging at least a portion of the closure's mounting opening at a location behind the back surface of the closure's front wall, for being fastener-connected to the front assembly means, and for defining back-surface engaging means for being clamped toward engagement with the back surface of the closure's front wall when the mounting flange of the first housing means is being clamped toward engagement with said portions of the closure's front surface;

ii) said mounting bracket means having a projection receiving opening formed therethrough, through which said projection means extends when said back-surface engaging means is fastener-connected to the front assembly means, with said projection receiving opening having a first end and an opposed second end, and with said projection receiving opening further being configured such that, 1) when said projection means is in said first position, a rearwardly projecting part of said projection means is located near said first end, and such that, 2) when said projection means is in said second position, the rearwardly projecting part of said projection means is located near said second end;

iii) a lever-type link pivotally connected to the mounting bracket, and having opposed first and second end formation means for being connected to first and second linkages to concurrently move the first and second linkages to concurrently operate first and second latch mechanisms, respectively; and, iv) an operating arm pivotally connected to the mounting bracket and to the elongate lever-type link for pivoting the lever-type link relative to the mounting bracket, with a designated part of the operating arm extending into engagement with said rearwardly projecting part of the projection means for being moved by the rearwardly projecting part of the projection means for transmitting motion from the projection means through the operating arm to the lever-type link to move the first and second linkages to concurrently operate the first and second latch mechanisms in response to the rearwardly projecting means being moved due to movement of the operating handle from the non-operated position to the operated position; and, c) fastener means for connecting and clamping toward each other the housing means and the mounting bracket means to thereby clamp the back-surface engaging means of the mounting bracket toward a position of engagement with the back surface of the closure's front wall, and to clamp the mounting flange of the pan-shaped housing toward a position of engagement with said portions of the closure's front surface.

2. The latch of claim 1 wherein said designated part of the operating arm moves from a primary position to a secondary position along a path of movement in response to movement of the projection means from the first position to the second position, and wherein the latch additionally includes key-operated lock means that is connected to the first housing means and that includes locking formation means for being moved between locked and unlocked positions in response to operation of the lock means by a suitably configured key, with the locking formation means being configured, when in its locked position, to extend into said path of movement to block said movement along said path when the locking formation means is so extended, and with the locking formation means being configured to not impede said movement along said path when the locking formation means is in its unlocked position.

3. The latch of claim 2 wherein the rear assembly means additionally includes biasing means connected to the operating arm for biasing said designated part of the operating arm away from said secondary position and toward said primary position.

4. The latch of claim 2 wherein the mounting bracket means has a lock-body-receiving opening formed therethrough, the key-operated lock means has a body that extends through the lock-body-receiving opening in close proximity thereto to restrict relative movement of the body of the lock means relative to the mounting bracket means, whereby the mounting bracket means serves to reinforce and rigidify the connection of the key-operated lock means to the latch.

5. The latch of claim 2 wherein the mounting bracket means defines a mounting post that extends rearwardly from a back wall of the mounting bracket; a central part of the operating arm is pivotally connected to the mounting post at a location spaced rearwardly from the back wall of the mounting bracket; the operating arm has a formation that extends forwardly from the central part toward the back wall of the mounting bracket, with the forwardly extending formation of the operating arm defining said designated part of the operating arm; said rearwardly projecting part of said projection means engages one side of the forwardly extending formation of the operating arm; and said locking formation means is extensible into and out of engagement with an opposite side of the forwardly extending formation to block movement of said designated part of the operating arm along said path of movement.

6. The latch of claim 5 additionally including torsion coil spring spring means connected to the operating arm and having coils that extend about a portion of the mounting post for biasing said designated part of the operating arm away from said secondary position and toward said primary position.

7. The latch of claim 2 wherein the designated part of the operating arm has a generally U-shaped portion that is defined by first and second opposed, spaced, rearwardly extending legs that each connect at one end with a one of two opposite ends of a third leg that extends closely alongside said rear wall of the mounting bracket means, with the first of the opposed legs being configured and positioned to be engaged by said rearwardly projecting part of said projecting means, and with the second of the opposed legs being configured and positioned to be engaged by said locking formation means when said locking formation means is in said locked position.

8. The latch of claim 1 additionally including lockable means for selectively blocking movement of said designated part of the operating arm in such a way that, and wherein the projection means is configured to cooperate with the lockable means and with the handle such that, when movement of the operating arm is blocked, movement of the handle out of its non-operated position also is blocked.

9. The latch of claim 1 wherein:

a) the mounting bracket means is defined, at least in part, by a stamped metal plate that has a first substantially flat portion that defines said rear wall and extends substantially parallel to the back wall of the pan-shaped housing when the rotary latch is mounted on the closure;

b) the mounting bracket means includes first mounting post means extending rearwardly from said rear surface for pivotally mounting the operating arm thereon; and, c) the mounting bracket means includes second mounting post means extending rearwardly from said rear surface for pivotally mounting the lever-type link thereon.

10. The latch of claim 9 wherein said designated part of the operating arm moves from a primary position to a secondary position in response to movement of said projection means from said first position to said second position, and the latch additionally includes biasing means connected to at least a selected one of the operating arm and the lever-type link for biasing the operating arm away from said secondary position toward said primary position.

11. The latch of claim 10 wherein said biasing means includes at least one torsion coil spring having portions that extends about at least a selected one of said first and second mounting post means.

12. The latch of claim 9 wherein the lever-type link is of generally T-shape as defined by an elongate formation that defines said first and second end formation means at opposite ends thereof, and that has a stem formation connected to the elongate formation mid-way along the length of the elongate formation, with the stem formation extending toward and being pivotally connected to the operating arm for being moved by the operating arm.

13. The latch of claim 1 wherein the fastener means includes first threaded fastener means 1) for being non-releasably connected to a selected one of the front assembly means and the rear assembly means, 2) for being releasably connected to the other of the front assembly means and the rear assembly means, and 3) for being tightened in place when connected to said other of the front and rear assembly means to clamp the front and rear assembly means toward each other.

14. The latch of claim 13 wherein the operating arm is pivotally connected to the mounting bracket means for movement about an axis that extends substantially perpendicular to said rear wall.

15. The latch of claim 14 wherein the lever-type link also is pivotally connected to the mounting bracket means for movement about a separate axis that extends substantially perpendicular to said rear wall.

16. The latch of claim 1 wherein the mounting flange of the pan-shaped housing is substantially flat, and the latch additionally includes outer gasket means having a curved surface and a non-uniform thickness for filling a space between and for providing a weather-tight seal between the flat mounting flange and a front surface of the closure that is curved so as to not extend parallel to the flat mounting flange.

17. The latch of claim 16 additionally including inner gasket means having an oppositely curved surface for assisting the outer gasket means to provide a weather-tight seal between the latch and the closure.

18. The latch of claim 1 additionally including biasing means for biasing the operating handle toward its non-operated position.

19. The latch of claim 18 wherein said biasing means includes spring means interposed between the operating handle and the pan-shaped housing.

20. The latch of claim 18 wherein said biasing means includes spring means connected to the operating arm and an element of the rear assembly means, and operable through the engagement of the operating arm with the projection means, and through the connection of the projection means with the operating handle to bias the operating handle toward its non-operated position.

21. The latch of claim 1 additionally including gasket means extending about said projection means at a location near said main back wall opening for sealing said main back wall opening against penetration therethrough of foreign matter.

22. The latch of claim 21 wherein said gasket means includes a gasket that is carried by said handle means for being movable therewith relative to the pan-shaped housing.

23. A lock including the operating mechanism of claim 1, first and second latch assembly means for being mounted on a closure at locations spaced from where the operating mechanism is mounted on the closure, first and second strike means for being latchingly engaged by the first and second latch assembly means when the closure is closed, and first and second linkage means for connecting the operating mechanism with the first and second latch assembly means for unlatching the first and second latch assembly means from engagement with the first and second strike means when the handle of the operating mechanism is moved from the non-operative position to the operative position.

24. The lock of claim 23 wherein the first and second latch assembly means includes at least one latch assembly having a spring-projected, sliding-type latch bolt.

25. The lock of claim 23 wherein the first and second latch assembly means includes at least one rotary latch assembly.

26. The lock of claim 25 wherein said at least one rotary latch assembly includes:

a) first and second side plates that, when extending in a predetermined spaced, parallel relationship, each have a first hex-shaped hole formed therethrough extending along a common first axis that extends substantially perpendicular to the planes of the parallel first and second plates, and each have a second hex-shaped hole formed therethrough extending along a common second axis that substantially parallels said first axis at a location spaced therefrom;

b) first and second elongate tubular mounting means for connecting the first and second side plates so as to extend in said predetermined spaced, parallel relationship, with each of the first and second mounting means having a central diameter at a location between opposed end regions, with the first mounting means extending along said first axis and having its opposed end regions closely fitting within and conformed to the shape of the first hex-shaped holes, and with the second mounting means extending along said second axis and having its opposed end regions closely fitting within and conformed to the shape of the second hex-shaped holes;

c) at least one U-shaped formation defined by at least a selected one of the first and second side plates and configured to receive a suitably configured strike formation therein;

d) rotary jaw means pivotally mounted on the central diameter of the first elongate tubular mounting means for being movable between a latched position and an unlatched position, and for defining another U-shaped formation configured to receive said suitably configured strike formation therein, with the rotary jaw means being capable of cooperating with said at least one U-shaped formation to receive and retain said suitably configured strike formation in said at least one U-shaped formation and said another U-shaped formation when the rotary jaw means is in the latched position, and to permit said suitably configured strike formation to move into and out of said at least one U-shaped formation and said another U-shaped formation when the rotary jaw means is in the unlatched position; and, e) rotary pawl means pivotally mounted on the central diameter of the second elongate tubular mounting means for being movable between release and retention positions, with the rotary pawl means being operable when the rotary pawl means is in the retention position and when the rotary jaw means is in the latched position to cooperate with the rotary jaw to releasably retain the rotary jaw means in the latched position.

27. The lock of claim 26 wherein said at least one rotary latch assembly additionally includes biasing means connected to at least one of the first and second tubular mounting means and to the rotary jaw means for biasing the rotary jaw means toward said unlatched position.

28. The lock of claim 27 wherein the biasing means also is connected to the rotary pawl means for biasing the rotary pawl means toward at least a selected one of said release and retention positions.

29. The lock of claim 25 wherein said at least one rotary latch assembly includes:

a) an elongate, generally rectangular first housing side plate having opposed end regions near opposite ends of the length thereof, and defining a first U-shaped notch located near one of the opposed end regions of the first housing side plate;

b) an elongate, generally rectangular second housing side plate having opposed end regions near opposite ends of the length thereof, and defining a second U-shaped notch located near one of the opposed end regions of the second housing side plate, with the second U-shaped notch being substantially aligned with the first U-shaped notch;

c) spacer means for extending transversely between, for rigidly connecting with, and for maintaining a substantially parallel relationship between the first and second housing side plates, with the spacer means including a first spacer that extends along a first transverse axis that intersects each of the first and second housing side plates at a location that is relatively near to the other end regions thereof, and with the spacer means also including a second spacer that extends along a second transverse axis that intersects each of the first and second housing side plates at a location that is substantially mid-way between the opposite ends thereof;

d) with the rotary latch assembly additionally including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with said selected housing side plate; and, e) with said operating arm being configured and positioned so as to be operable to move the rotary pawl to release rotary jaw from being retained in its latched position in response to movement of the operating handle away from its non-operated position toward its operated position to thereby release said strike formation from being concurrently received within and latchingly retained within the confines of the first, second and third U-shaped notches.

30. The lock of claim 29 wherein:

a) the first and second housing side plates each have first hex-shaped openings formed therethrough that extend along the first transverse axis, and each have second hex-shaped openings formed therethrough that extend along the second transverse axis; and, b) the first and second spacers are elongate, with the first spacer having opposed end regions that are closely fitted within said first hex-shaped openings to assist in forming rigid, rotation-resistant connections between the first spacer and the first and second housing side plates, with the second spacer having opposed end regions that are closely fitted with said second hex-shaped openings to assist in forming rigid, rotation-resistant connections between the second spacer and the first and second housing side plates.

31. The latch of claim 29 wherein the first and second U-shaped notches open generally in a direction that is substantially opposite to a direction of travel that is followed by the closure in moving away from its closed position toward an open position, with each of the first and second notches being defined, at least in part, by a pair of spaced-apart side surfaces that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch.

32. The latch of claim 29 wherein the U-shaped notch that is defined by said selected housing side plate defines a strike engagement surface that is configured to be directly engaged by a strike formation that is received within the first, second and third U-shaped notches, said transversely extending flange is located in close proximity to the strike engagement surface, and said flange is connected to such portions of said selected housing side plate as define the strike engagement surface by a relatively small radius right angle bend, with said flange and said bend cooperating to rigidify and strengthen such portions of said selected housing side plate as define the strike engagement surface.

33. The latch of claim 29 wherein the first U-shaped notch is defined, at least in part, by an associated first strike engagement surface, the second U-shaped notch is defined, at least in part by an associated second strike engagement surface, the first and second strike engagement surfaces are aligned so as to extend substantially congruently and are configured to be directly engaged by a strike formation that is received within the first, second and third U-shaped notches, said transversely extending flange is located in close proximity to a selected one of said associated strike engagement surfaces, said flange is connected to such portions of said selected housing side plate as define said selected associated strike engagement surface by a relatively small radius right angle bend, with said flange and said bend cooperating to rigidify and strengthen such portions of said selected housing side plate as define said selected associated strike engagement surface.

34. The latch of claim 29 wherein:

a) the first and second U-shaped notches open generally in a direction that is substantially opposite to a direction of travel that is followed by the closure in moving away from its closed position toward an open position;

b) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, c) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

35. The latch of claim 29 wherein at least one of the first and second spacers has at least one selected end region that extends into a separate, hex-shaped opening formed through a selected one of the first and second housing side plates and is expanded to fit tightly within said hex-shaped opening to form a secure, rotation resistant connection between the selected spacer end region and the selected housing side plate.

36. The latch of claim 29 wherein each of the first and second spacers has its opposite end regions extending into separate, hex-shaped openings formed through the first and second housing side plates and expanded in place in said hex-shaped openings to provide secure, tight fitting connections between the first and second spacers and the first and second housing side plates that resist rotation of the first and second spacers about said first and second transverse axes relative to the first and second housing side plates.

37. A rotary latch assembly, comprising:

a) first and second side plates that, when extending in spaced, parallel relationship, each have a first hex-shaped hole formed therethrough extending along a common first axis that extends substantially perpendicular to the planes of the parallel first and second plates, and that each have a second hex-shaped hole formed therethrough extending along a common second axis that substantially parallels said first axis at a location spaced therefrom;

b) first and second elongate tubular mounting means having each having a central diameter that is greater than are diameters of opposed end regions of the first and second mounting means, with the end region diameters of the first mounting means having been inserted into the first hex-shaped holes and expanded therein to mate closely with the first hex-shaped holes and to define expanded first formation means for establishing rigid connections between the first mounting means and the first and second side plates, with the end region diameters of the second mounting means having been inserted into the second hex-shaped holes and expanded therein to mate closely with the second hex-shaped holes and to define expanded second formation means for establishing rigid connections between the second mounting means and the first and second side plates, with said rigid connections cooperating to hold the first and second side plates in spaced, parallel relationship;

c) at least one U-shaped formation defined by at least a selected one of the first and second side plates and configured to receive a suitably configured strike formation therein;

d) rotary jaw means pivotally mounted on the central diameter of the first elongate tubular mounting means for being movable between a latched position and an unlatched position, and for defining another U-shaped formation configured to receive said suitably configured strike formation therein, with the rotary jaw means being capable of cooperating with said at least one U-shaped formation to receive and retain said suitably configured strike formation in said at least one U-shaped formation and said another U-shaped formation when the rotary jaw means is in the latched position, and to permit said suitably configured strike formation to move into and out of said at least one U-shaped formation and said another U-shaped formation when the rotary jaw means is in the unlatched position; and, e) rotary pawl means pivotally mounted on the central diameter of the second elongate tubular mounting means for being movable between release and retention positions, with the rotary pawl means being operable when the rotary pawl means is in the retention position and when the rotary jaw means is in the latched position to cooperate with the rotary jaw to releasably retain the rotary jaw means in the latched position.

38. The lock of claim 37 wherein the rotary latch assembly additionally includes biasing means connected to at least one of the first and second tubular mounting means and to the rotary jaw means for biasing the rotary jaw means toward said unlatched position.

39. The lock of claim 38 wherein the biasing means also is connected to the rotary pawl means for biasing the rotary pawl means toward at least a selected one of said release and retention positions.

40. A flush-mountable, handle-operable two-point lock for mounting on a closure for releasably retaining the closure in a closed position by latchingly engaging a pair of suitably configured strike formations when the closure is in its closed position, comprising:

a) flush-mountable front assembly means for mounting as a first modular assembly on a closure adjacent a mounting opening that is formed through a front wall of the closure, including:

i) first housing means including a one-piece pan-shaped housing for being mounted on a closure adjacent the mounting opening, with the housing having a combination of back and side walls that cooperate to define a substantially rectangular, forwardly-facing recess, and with the housing having a substantially flat mounting flange that extends principally in an imaginary front plane 1) to perimetrically surround the forwardly-facing recess, 2) to closely overlie portions of a front surface of the closure's front wall that extend perimetrically about the mounting opening, and 3) to be clamped toward engagement with said portions of the closure's front surface to substantially flush-mount the pan-shaped housing on the closure;

ii) with the back and side walls being configured such that the forwardly-facing recess has 1) a generally rectangular shape, 2) having a main back wall portion that is substantially flat and extends in an imaginary main back wall plane that substantially parallels the imaginary front plane, and 3) having a minor back wall portion that is substantially flat and extends in an imaginary minor back wall plane that substantially parallels the imaginary front plane and the imaginary main back wall plane at a location spaced between the imaginary back wall plane and the imaginary front plane;

iii) a main back wall opening formed through the main back wall portion, and a minor back wall opening formed through the minor back wall portion;

iv) handle means including an operating handle that is at least partially nested within the recess, and that is connected to the first housing means for movement relative to the pan-shaped housing between a non-operated position and an operated position; and, v) projection means connected to the handle and extending rearwardly through the main back wall opening for being moved by movement of the handle such that, 1) when the handle is in the non-operated position, the projection means is caused by its connection to the handle to be in a first position, 2) when the handle is moved from the non-operated position to the operated position, the projection means is caused by such movement to move from the first position to a second position, and 3) when the handle is moved from the operated position to the non-operated position, the projection means is caused by such movement to move from the second position to the first position;

b) rear assembly means for mounting as a second modular assembly on the closure, for being connected to the front assembly means to clampingly draw the mounting flange toward engagement with said portions of the closure's front surface to securely mount the rotary latch on the closure, including:

i) mounting bracket means including a mounting bracket for overlying at least a portion of the main back wall portion and at least a portion of the minor back wall portion, for bridging at least a portion of the closure's mounting opening at a location behind the back surface of the closure's front wall, for being fastener-connected to the front assembly means, and for defining back-surface engaging means for being clamped toward engagement with the back surface of the closure's front wall when the mounting flange of the first housing means is being clamped toward engagement with said portions of the closure's front surface;

ii) said mounting bracket means having a projection receiving opening formed therethrough for being aligned with the main back wall opening such that said projection means extends through the projection receiving opening when said mounting bracket means is fastener-connected to the front assembly means, with said projection receiving opening having a first end and an opposed second end, and with said projection receiving opening further being configured 1) such that, when said projection means is in said first position, a rearwardly projecting part of said projection means is located near said first end, 2) such that, when said projection means is in said second position, the rearwardly projecting part of said projection means is located near said second end, and 3) such that, when said projection means is moved between said first and second positions, said rearwardly projecting part of said projection means moves along a path of movement that is defined by the projection receiving opening; and, iii) said mounting bracket means having a lock mechanism receiving opening formed therethrough for being aligned with the minor back wall opening;

c) lock means including a lock mechanism having a body and a locking formation that is movable relative to the body, with the body having 1) a front portion that is mountable within the minor back wall opening, and 2) a rear portion that is configured to extend through the lock mechanism receiving opening in a sufficiently close fit to enable such portions of the mounting bracket means as surround the lock mechanism receiving opening to assist such portions of the first housing means as surround the minor back wall opening to maintain proper positioning of the mounted lock mechanism when the mounting bracket means is fastener-connected to the front assembly means, and with the locking formation being movable relative to the body of the mounted lock mechanism between a locking position located relatively close to said projection receiving opening, and an unlocking position located relatively farther from said projection receiving opening;

d) latch means including first and second latch assemblies for being mounted on a closure at first and second locations spaced from where the operating mechanism means is mounted on the closure;

e) link means for connecting with the projection means and with the first and second latch assemblies for concurrently unlatching the first and second latch assemblies in response to movement of the projection means from said first position to said second position; and, f) fastener means for connecting and clamping toward each other the housing means and the mounting bracket means to thereby clamp the back-surface engaging means of the mounting bracket toward a position of engagement with the back surface of the closure's front wall, and to clamp the mounting flange of the pan-shaped housing toward a position of engagement with said portions of the closure's front surface.

41. The lock of claim 40 wherein the link means includes:

a) first and second elongate links connected respectively to the first and second latch assemblies and being operative, when moved in a predetermined manner, to unlatch the first and second latch assemblies;

b) a lever-type link pivotally connected to the mounting bracket, and having opposed first and second end formation means connected to first and second linkages for concurrently moving the first and second elongate links in said predetermined manner; and, c) an operating arm pivotally connected to the mounting bracket and to the elongate lever-type link for pivoting the lever-type link relative to the mounting bracket, with a designated part of the operating arm extending into engagement with said rearwardly projecting part of the projection means for being moved by the rearwardly projecting part of the projection means for transmitting motion from the projection means through the operating arm to the lever-type link to move the first and second elongate links in said predetermined manner to concurrently unlatch the first and second latch assemblies.

42. The lock of claim 41 additionally including biasing means connected to the operating arm for biasing said designated part of the operating arm away from said secondary position and toward said primary position.

43. The lock of claim 40 wherein at least one of the first and second latch assemblies has a spring-projected, sliding-type latch bolt.

44. The lock of claim 40 wherein the first and second latch assembly means includes at least one rotary latch assembly.

45. The lock of claim 44 wherein said at least one rotary latch assembly includes:

a) first and second side plates that, when extending in a predetermined spaced, parallel relationship, each have a first hex-shaped hole formed therethrough extending along a common first axis that extends substantially perpendicular to the planes of the parallel first and second plates, and each have a second hex-shaped hole formed therethrough extending along a common second axis that substantially parallels said first axis at a location spaced therefrom;

b) first and second elongate tubular mounting means for connecting the first and second side plates so as to extend in said predetermined spaced, parallel relationship, with each of the first and second mounting means having a central diameter at a location between opposed end regions, with the first mounting means extending along said first axis and having its opposed end regions closely fitting within and conformed to the shape of the first hex-shaped holes, and with the second mounting means extending along said second axis and having its opposed end regions closely fitting within and conformed to the shape of the second hex-shaped holes;

c) at least one U-shaped formation defined by at least a selected one of the first and second side plates and configured to receive a suitably configured strike formation therein;

d) rotary jaw means pivotally mounted on the central diameter of the first elongate tubular mounting means for being movable between a latched position and an unlatched position, and for defining another U-shaped formation configured to receive said suitably configured strike formation therein, with the rotary jaw means being capable of cooperating with said at least one U-shaped formation to receive and retain said suitably configured strike formation in said at least one U-shaped formation and said another U-shaped formation when the rotary jaw means is in the latched position, and to permit said suitably configured strike formation to move into and out of said at least one U-shaped formation and said another U-shaped formation when the rotary jaw means is in the unlatched position; and, e) rotary pawl means pivotally mounted on the central diameter of the second elongate tubular mounting means for being movable between release and retention positions, with the rotary pawl means being operable when the rotary pawl means is in the retention position and when the rotary jaw means is in the latched position to cooperate with the rotary jaw to releasably retain the rotary jaw means in the latched position.

46. The lock of claim 44 wherein said at least one rotary latch assembly includes:

a) an elongate, generally rectangular first housing side plate having opposed end regions near opposite ends of the length thereof, and defining a first U-shaped notch located near one of the opposed end regions of the first housing side plate;

b) an elongate, generally rectangular second housing side plate having opposed end regions near opposite ends of the length thereof, and defining a second U-shaped notch located near one of the opposed end regions of the second housing side plate, with the second U-shaped notch being substantially aligned with the first U-shaped notch;

c) spacer means for extending transversely between, for rigidly connecting with, and for maintaining a substantially parallel relationship between the first and second housing side plates, with the spacer means including a first spacer that extends along a first transverse axis that intersects each of the first and second housing side plates at a location that is relatively near to the other end regions thereof, and with the spacer means also including a second spacer that extends along a second transverse axis that intersects each of the first and second housing side plates at a location that is substantially mid-way between the opposite ends thereof;

d) with the rotary latch assembly additionally including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its law-retaining position as the rotary jaw moves to its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with said selected housing side plate.

47. The lock of claim 46 wherein:

a) the first and second housing side plates each have first hex-shaped openings formed therethrough that extend along the first transverse axis, and each have second hex-shaped openings formed therethrough that extend along the second transverse axis; and, b) the first and second spacers are elongate, with the first spacer having opposed end regions that are closely fitted within said first hex-shaped openings to assist in forming rigid, rotation-resistant connections between the first spacer and the first and second housing side plates, with the second spacer having opposed end regions that are closely fitted with said second hex-shaped openings to assist in forming rigid, rotation-resistant connections between the second spacer and the first and second housing side plates.

48. The latch of claim 46 wherein the first and second U-shaped notches open generally in a direction that is substantially opposite to a direction of travel that is followed by the closure in moving away from its closed position toward an open position, with each of the first and second notches being defined, at least in part, by a pair of spaced-apart side surfaces that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch.

49. The latch of claim 46 wherein the U-shaped notch that is defined by said selected housing side plate defines a strike engagement surface that is configured to be directly engaged by a strike formation that is received within the first, second and third U-shaped notches, said transversely extending flange is located in close proximity to the strike engagement surface, and said flange is connected to such portions of said selected housing side plate as define the strike engagement surface by a relatively small radius right angle bend, with said flange and said bend cooperating to rigidify and strengthen such portions of said selected housing side plate as define the strike engagement surface.

50. The latch of claim 46 wherein the first U-shaped notch is defined, at least in part, by an associated first strike engagement surface, the second U-shaped notch is defined, at least in part, by an associated second strike engagement surface, the first and second strike engagement surfaces are aligned so as to extend substantially congruently and are configured to be directly engaged by a strike formation that is received within the first, second and third U-shaped notches, said transversely extending flange is located in close proximity to a selected one of said associated strike engagement surfaces, said flange is connected to such portions of said selected housing side plate as define said selected associated strike engagement surface by a relatively small radius right angle bend, with said flange and said bend cooperating to rigidify and strengthen such portions of said selected housing side plate as define said selected associated strike engagement surface.

51. The latch of claim 46 wherein:

a) the first and second U-shaped notches open generally in a direction that is substantially opposite to a direction of travel that is followed by the closure in moving away from its closed position toward an open position;

b) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, c) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

52. The latch of claim 46 wherein at least one of the first and second spacers has at least one selected end region that extends into a separate, hex-shaped opening formed through a selected one of the first and second housing side plates and is expanded to fit tightly within said hex-shaped opening to form a secure, rotation resistant connection between the selected spacer end region and the selected housing side plate.

* * * * *